US007824126B2

(12) United States Patent
Costa

(10) Patent No.: US 7,824,126 B2
(45) Date of Patent: Nov. 2, 2010

(54) METHOD AND SYSTEM FOR STOPPING A VEHICLE

(75) Inventor: James M. Costa, North Eastham, MA (US)

(73) Assignee: JCCS Inc., North Eastham, MA (US)

( * ) Notice: Subject to any disclaimer, the term of this patent is extended or adjusted under 35 U.S.C. 154(b) by 167 days.

(21) Appl. No.: 11/784,282

(22) Filed: Apr. 6, 2007

(65) Prior Publication Data

US 2008/0159809 A1 Jul. 3, 2008

Related U.S. Application Data

(60) Provisional application No. 60/790,019, filed on Apr. 7, 2006.

(51) Int. Cl.
*E01F 13/12* (2006.01)

(52) U.S. Cl. ..... 404/6; 293/116; 293/117; 180/274; 180/281

(58) Field of Classification Search ..... 404/6; 293/108, 116–119; 296/187–187.1
See application file for complete search history.

(56) References Cited

U.S. PATENT DOCUMENTS

| | | | | |
|---|---|---|---|---|
| 2,107,312 | A | 2/1936 | Thompson | |
| 2,157,612 | A | 1/1938 | Kirk | |
| 2,194,623 | A | 1/1938 | Thompson | |
| 5,503,059 | A | 4/1996 | Pacholok | |
| 5,611,408 | A | 3/1997 | Abukhader | |
| 5,645,137 | A | 7/1997 | Pacholok | |
| 5,839,759 | A | 11/1998 | Trigo | |
| 5,839,849 | A | 11/1998 | Pacholok | |
| 5,921,704 | A | 7/1999 | Pacholok | |
| 5,933,075 | A | 8/1999 | Ditson | |
| 5,952,600 | A | 9/1999 | Herr | |
| 6,527,475 | B1 | 3/2003 | Lowrie | |
| 6,623,205 | B1 | 9/2003 | Ramirez | |
| 6,650,283 | B2 | 11/2003 | Brydges | |
| 7,108,446 | B2 * | 9/2006 | Clark | 404/9 |
| 7,210,875 | B1 | 5/2007 | Christle et al. | |
| 7,452,015 | B1 * | 11/2008 | Stock, Jr. | 293/118 |
| 2003/0137448 | A1 | 7/2003 | Brydges | |
| 2005/0214071 | A1 | 9/2005 | Collier | |
| 2005/0225163 | A1 | 10/2005 | Boll | |

FOREIGN PATENT DOCUMENTS

| | | |
|---|---|---|
| GB | 2166225 | 4/1986 |
| JP | 2000303418 | 10/2000 |

OTHER PUBLICATIONS

International Search Report and Written Opinion for International Application No. PCT/US2007/008654 dated Sep. 12, 2007 (13 pgs.).

* cited by examiner

*Primary Examiner*—Raymond W Addie
(74) *Attorney, Agent, or Firm*—Goodwin Procter LLP

(57) ABSTRACT

Apparatus and associated methods for safely capturing a moving vehicle are disclosed. The method includes biasing a portion of a loop of cable against the rear portion of one or more tires of a target vehicle, such that the cable is carried over the tire and engages the rear axle, or another portion, of the target vehicle. The loop of cable can be connected to a stationary or mobile structure that can then provide a force to the cable to safely slow down and stop the target vehicle.

18 Claims, 16 Drawing Sheets

METHOD AND SYSTEM FOR STOPPING A VEHICLE

CROSS-REFERENCE TO RELATED APPLICATIONS

This application claims priority to, and the benefit of, U.S. provisional patent application Ser. No. 60/790,019, filed on Apr. 7, 2006, the disclosure of which is incorporated herein by reference in its entirety.

FIELD OF THE INVENTION

The present invention relates generally to the field of vehicle capture systems, and more particularly to an apparatus for mounting to a mobile or stationary structure to enable the capturing and stopping of a target vehicle, and related methods.

BACKGROUND OF THE INVENTION

Law enforcement officers are often faced with the task of pursuing suspects in vehicles. In the United States, police pursuits of vehicles are responsible for hundreds of deaths each year, and millions of dollars worth of property damage. These vehicle pursuits cost the law enforcement community significant time, effort, cost, and legal fees as a result of lawsuits from victims of car chases gone wrong. As a result, the guidelines for when to pursue and when not to pursue a suspect are constantly changing, and vary from state to state. This can result in significant problems for the law enforcement community in determining how to react when faced with a vehicle pursuit situation, where a law enforcement officer may have to make an immediate determination, in the field, as to whether the risk to public safety from initiation of a pursuit outweighs the risk to the public from letting the occupants of a pursued vehicle escape.

A number of methods and apparatus to assist in the task of safely stopping a pursued vehicle have been proposed. These include the use of tire deflation devices that are deployed in front of a moving vehicle to puncture one or more tires as the vehicle passes over the device. See, for example, U.S. Pat. Nos. 5,611,408, 5,839,849, 6,623,205, and 6,527,475. These devices, however, all require the placement of the deflation device in front of the tires of the vehicle being pursued, and all result in the puncturing of one or more tires, thus damaging the vehicle without necessarily stopping it safely.

Another proposed vehicle stopping apparatus includes the use of a loop, including spiked portions, that can be deployed in front of a moving vehicle and that is wrapped up onto the axle of the vehicle when the spiked portion attaches to the tires passing over it. See U.S. Patent Application No. 2005/0225163, the disclosure of which is incorporated herein by reference in its entirety. Again, however, this device must be placed in front of the tires of the vehicle being pursued, and may also result in the puncturing of one or more tires of the targeted vehicle with associated damage.

Other proposed vehicle capturing devices have included the use of hooks, or other grabbing mechanisms, that are mounted on a pursuing vehicle to directly engage the rear of a pursued vehicle. See, for example, U.S. Pat. Nos. 2,107,312, 2,157,612, 2,194,623, and 5,839,759. These devices, however, all appear to require that the pursuing vehicle is positioned directly behind the pursued vehicle and physically impacts the pursued vehicle to engage the device. This may result in the need for highly dangerous maneuvering at high speed by the pursuing vehicle in order to use the device, and may result in significant damage to the vehicle being grabbed.

Other means of disabling a vehicle have been proposed. These include the use of electromagnetic, microwave, ultraviolet, or other appropriate signals that are transmitted to a vehicle to disrupt and/or stop the vehicle's engine. See, for example, U.S. Pat. Nos. 5,952,600 and 5,503,059. These devices can, however, pose an inadvertent threat to equipment such as police and emergency vehicle radios, traffic signals, cell phones, and pacemakers located within the range of the transmitter, as well as the pursuit vehicles themselves.

As such, there is still a need for a vehicle capture device that can be deployed safely and efficiently to stop a vehicle without permanently damaging the vehicle or requiring dangerous maneuvering by the pursuing vehicle prior to deployment.

SUMMARY OF THE INVENTION

In general, the invention is directed toward apparatus and methods for slowing and/or stopping a vehicle.

One aspect of the invention includes a vehicle capture system. This vehicle capture system can include a loop adapted to be anchored to an arresting member, and means for biasing a portion of the loop against a rear portion of at least one tire of a target vehicle. The biasing means causes the portion of the loop to be carried over the at least one tire to engage the target vehicle.

In one embodiment, the loop can include at least one cable. The biasing means can include at least one tensioning element coupled to the loop. In one embodiment, the biasing means can include at least one projectile coupled to the loop. The vehicle capture system can further include at least one firing mechanism adapted to propel the at least one projectile.

In one embodiment, the vehicle capture system can further include at least one cable stowage element adapted to stow at least a portion of the loop prior to activating the firing mechanism. The at least one projectile can be selected from the group consisting of a rocket, a missile, and a weight. The at least one firing mechanism can include the use of compressed air. In one embodiment, a release mechanism can be adapted to release the loop from the arresting member when mounted thereto. The vehicle capture system can also include a controller adapted to activate the biasing means.

Another aspect of the invention includes a method of capturing a vehicle. The method can include the steps of providing a loop anchored to an arresting member, biasing at least a portion of the loop against a rear portion of at least one tire of a target vehicle, the biasing means sufficient to cause the portion of the loop to be carried over the at least one tire to engage the target vehicle, and applying tension to the loop with the arresting member to stop the target vehicle.

In one embodiment, the loop can include at least one cable. The biasing means can include at least one tensioning element coupled to the loop. The biasing means can include at least one projectile coupled to the loop. The biasing means can further include at least one firing mechanism adapted to propel the at least one projectile. The at least one projectile can be selected from the group consisting of a rocket, a missile, and a weight. The arresting member can include at least one stationary structure and/or at least one mobile structure.

In one embodiment, the method can further include the step of positioning the mobile structure substantially behind the target vehicle prior to the biasing step. The method can further include the step of releasing the loop from the arresting member. In one embodiment, the loop may additionally engage the emergency brake of the target vehicle, thereby aiding in the controlled safe stop.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

The invention provides a method for engaging and snaring one or more tires of a target vehicle while it is moving, thus allowing the target vehicle to be quickly and safely captured and stopped with minimal damage to the vehicle and minimum risks to the operator of the apparatus and any surrounding people, vehicles, and/or property. This method of capturing a target vehicle may, in one embodiment, include the use of a cable stretched out behind the target vehicle and biased against the rear wheels of the vehicle in such a manner that the rotation of the rear wheels picks up and carries the cable over at least one of them, thereby snaring or "lassoing" the axle of the vehicle.

The apparatus and methods described herein may be of great value in a number of security areas, such as, but not limited to, law enforcement (local, state, federal, and international), CIA, FBI, secret service, homeland security, counter terrorism, and military applications. For example, a stationary and/or a mobile vehicle capture system may be used in either civilian or military mobile checkpoints to protect against terrorist activities such as, but not limited to, car bombing. This device can counter the use of car bombs by both stopping the weapon from reaching its destination and enabling soldiers to refrain from using immediate lethal force on a vehicle that is being operated erratically for unknown reasons. This method and system of capturing a vehicle may also be safer than prior techniques, as the cable impinging on the tires will generally not burst the tires or provide any danger to the gas tank or other elements of the target vehicle.

The means of deploying the capture cable, or loop, may include, but is not limited to, the use of one or more compressed air rockets, pyrotechnic rockets, compressed air or mechanically powered telescoping poles, and/or compressed air, mechanical, or pyrotechnic cannons. In one example embodiment, the vehicle capture system may include two poles, with cable attached, that are fired simultaneously from a pursuing vehicle. Once deployed, these poles may operate independently of the pursuing car to seize the rotation of the rear axle or tires of the pursued target vehicle. In an alternative embodiment, a steel mesh net may be used in conjunction with, or in place of, the capture cable.

Figure 1A:
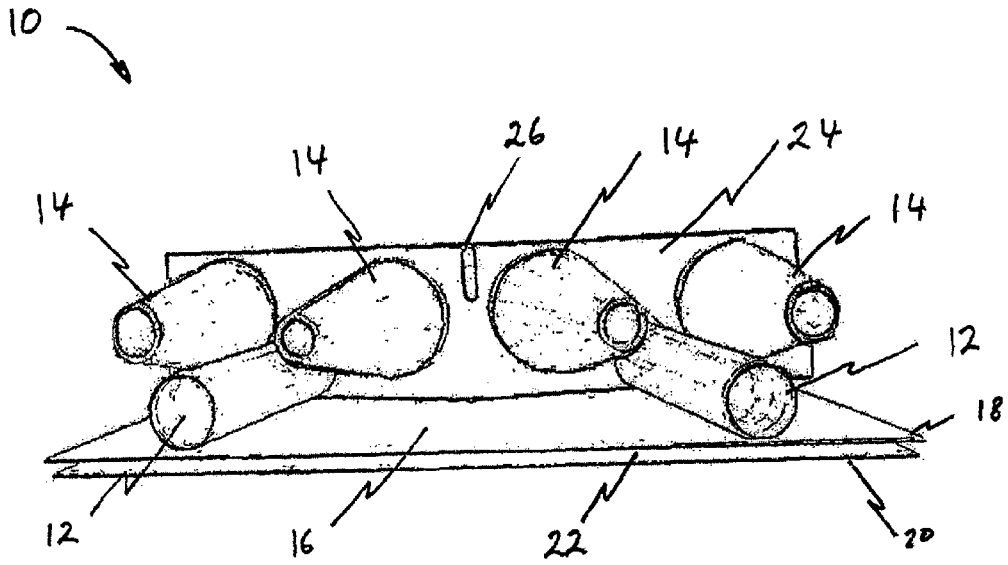
FIG. 1A is a schematic front view of a vehicle capture system, in accordance with one embodiment of the invention.

An example embodiment of a vehicle capture system for use on a pursuing vehicle is shown in FIGS. 1A to 1G. FIG. 1A shows a vehicle capture system 10 without the capture cable attached. In this embodiment, the vehicle capture system 10 includes two projectile tubes 12, each configured to store a projectile. Each projectile tube 12 can include a firing mechanism configured to propel the projectile out of the projectile tube 12 upon activation of the vehicle capture system 10. In one embodiment, a single firing mechanism is used to initiate the launch of the projectiles from both projectile tubes 12 simultaneously. In an alternative embodiment, separate firing mechanisms may be used for each projectile tube 12, allowing the projectiles to be propelled from the projectile tubes 12 simultaneously or separately, as required.

The vehicle capture system 10 also includes a number of cable stowage elements 14 associated with each projectile tube 12. In this embodiment, two cable stowage elements 14 are associated with each projectile tube 12, although in alternative embodiments any appropriate number of cable stowage elements 14 may be used. The cable stowage elements 14 are configured to releasably hold one or more capture cables in place prior to activation of the vehicle capture system 10. Upon activation, the cable stowage elements 14 allow the capture cable to be deployed safely and quickly without becoming tangled or otherwise restricted. In the embodiment of FIGS. 1A to 1G the cable stowage elements 14 are substantially cone shaped structures, although in alternative embodiments any appropriate stowage element, including, but not limited to, a cylindrical or partially spherical structure, and/or an open or openable stowage bin, may be used.

A further cable stowage element 16 is positioned below the projectile tubes 12, and cable stowage elements 14, to store a further portion of the capture cable. In the embodiment of FIGS. 1A to 1G the cable stowage element 16 includes an upper sheet 18 and a lower sheet 20, with a space 22 therebetween. This space 22 is configured to hold a portion of the capture cable prior to activation of the vehicle capture system 10, while allowing the capture cable to be deployed safely and quickly upon activation of the vehicle capture system 10.

The projectile tubes 12, cable stowage elements 14, and cable stowage element 16 are supported on a frame 24. This frame 24 can then in turn be mounted to a mobile structure, such as, but not limited to, a police patrol vehicle or other appropriate vehicle. An anchoring element 26 is also supported by the frame 24. This anchoring element 26 can be used to anchor the capture cable to the vehicle capture system 10. In one embodiment of the invention, the anchoring element 26 is an eye bolt. In an alternative embodiment, the anchoring element 26 may include a hook, a clasp, a welded or formed loop, or any other appropriate means for holding the capture cable.

The anchoring element 26 may include a latch or other release mechanism allowing a capture cable to be attached to, and released from, the anchoring element 26 as required. In one embodiment this release mechanism may be triggered remotely from an operator of the vehicle to which the vehicle capture system 10 is attached. In an alternative embodiment, the release mechanism may be automatically triggered upon a set condition being met, such as an excessive load being felt by the anchoring element 26. In a further alternative embodiment, the release mechanism may need to be manually triggered, such as by unscrewing or otherwise physically releasing at least a portion of the anchoring element 26.

In one embodiment of the invention, the projectile tubes 12 are constructed from hollow aluminum tubes, the frame 24 is constructed from boxed steel, the cable stowage elements 14 are plastic, the cable stowage element 16 is aluminum, and the anchoring element 26 is steel. The projectile tubes 12, the cable stowage elements 14, and the cable stowage element 16 need not be constructed from steel as they will not be subject to significant loading once the capture cable has been deployed and snared a target vehicle. In an alternative embodiment of the invention, any of the projectile tubes 12, the cable stowage elements 14, and the cable stowage element 16 may be constructed from steel, aluminum, any other metal, plastic, wood, composite materials, or any other appropriate material.

The frame 24 and anchoring element 26 may however be subject to a significant load, and should therefore be constructed from a material capable of safely handling this load, such as tempered steel. In an alternative embodiment, the frame 24 and/or anchoring element 26 can be constructed from another metal, such as aluminum, a composite material, a plastic, or any other material with sufficient strength and other material properties to withstand the loads produced by the capture cable.

In one embodiment, the vehicle capture system 10 may be constructed from a single molded or machined piece, while in an alternative embodiment different elements of the vehicle capture system 10 may be constructed from different pieces of the same, or different, materials that can be welded, glued, screwed together, or otherwise attached, as appropriate.

Figure 1B:
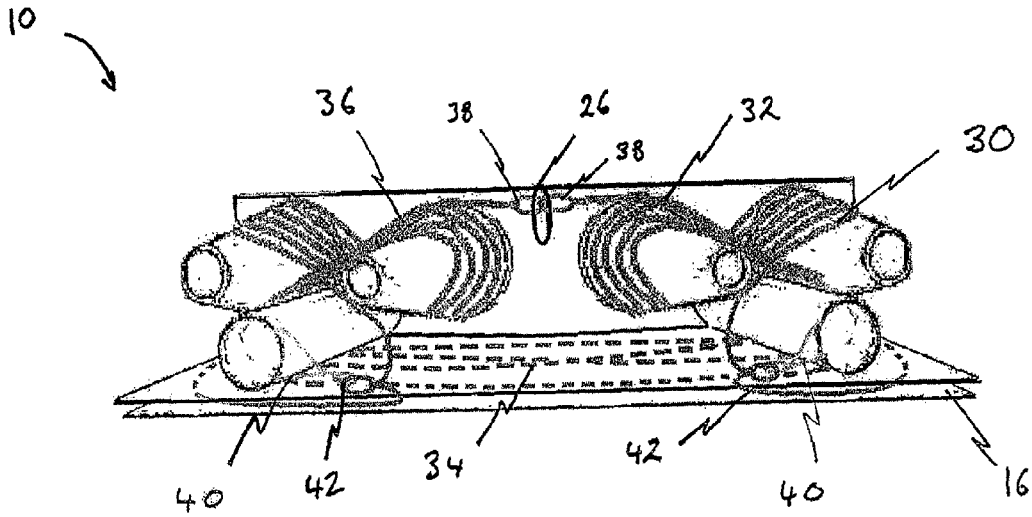
FIG. 1B is a schematic front view of the vehicle capture system of FIG. 1A including an attached loop.

A vehicle capture system 10 including a capture cable 30 is shown in FIG. 1B. Here, the capture cable 30 includes three sections. A first cable section 32 is connected at a first end to the anchoring element 26. The first section is stowed in place prior to deployment by being wound about two cable stowage elements 14, and is coupled at a second end to a first projectile within one of the projectile tubes 12. A second cable section 34 is coupled at one end to the first projectile within a first projectile tube 12, and coupled at its other end to a second projectile within the second projectile tube 12. This second cable section 34 is stowed in place prior to deployment within the cable stowage element 16. A third cable section 36 is coupled at one end to the second projectile within the second projectile tube 12, and coupled at its other end to the anchoring element 26.

In one embodiment, the first cable section 32 and the third cable section 36 of the capture cable 30 are each wound around two cable stowage elements 14 in a figure eight configuration. The second cable section 34 may be stowed within the cable stowage element 16 in a series of coiled rows. Such configurations allow the capture cable 30 to be compactly secured in place prior to deployment while providing minimal resistance to the capture cable 30 as it is pulled from the vehicle capture system 10 by the projectiles without snagging during deployment. In an alternative embodiment, any other appropriate stowage configuration may be utilized.

The capture cable 30 may be connected to the anchoring element 26 by looped connecting elements 38 at the ends of the capture cable 30. The capture cable 30 may alternatively be tied to the anchoring element 26, gripped by a gripping element of an anchoring element 26, or otherwise connected to the frame 24 of the vehicle capture system 10. In an alternative embodiment, the capture cable 30 may be coupled directly to the frame 24 without the need for a separate anchoring element 26. In a further alternative embodiment, the capture cable 30 may be a single closed loop of cable that can simply be hooked onto the anchoring element 26, either by a looped connecting element or directly by passing the closed loop of cable through the anchoring element 26.

In one embodiment of the invention the first cable section 32, second cable section 34, and third cable section 36 are all part of a single loop of cable making up the capture cable 30. In an alternative embodiment, the capture cable 30 may be constructed from a number or separate cables, which may or may not correspond with the first cable section 32, second cable section 34, and third cable section 36. For example, in one embodiment, the three cable sections 32, 34, and 36 each comprise a separate length of cable. These three portions are then coupled together to form the capture cable 30. The cables may be connected by splicing, welding, gluing, linking by a separate linking element, or by any other appropriate means capable of providing a sufficiently strong connection.

The cable, or cables, may be, for example, a ¼" diameter stainless steel cable. In an alternative embodiment, any metal, fiber, polymer, and/or composite material may be used for the cables. In one embodiment, the cable may be coated with a protective coating, such as a rubber or plastic coating. A rubber coating, for example, may be useful in protecting the capture cable from the elements prior to deployment, while also providing an additional element of resilience to the cable when deployed. A coating on the capture cable may also improve the capture cable's ability to be ensnared by the target vehicle's tires when deployed, by increasing the friction between the moving tire and the cable when it impinges upon the rear of the tire. In an alternative embodiment, any appropriate material may be used to provide a coating for the capture cable. The coating may cover the entire capture cable, or only be placed on one or more sections of the cable, or portions thereof. In an alternative embodiment, a plurality of spiked elements may be placed on at least a portion of the capture cable to provide an additional means of successfully gripping the capture cable to a tire; however, it has been demonstrated that no elements or coatings are necessary for the invention to function as intended.

In one embodiment of the invention, the capture cable 30 may be directly coupled to the projectiles at the locations where the first cable section 32 and second cable section 34 meet, and where the second cable section 34 and third cable section 36 meet. For example, the capture cable 30 may be passed through an anchoring element, such as a ring or eye bolt, directly attached to each projectile. In an alternative embodiment, separate elements may connect the capture cable 30 to the projectiles. These may, for example be separate cable elements 40 that are coupled to the projectile and the capture cable 30. These cable elements 40 may be passed through an anchoring element, such as a ring or eye bolt, directly attached to each projectile, or be tied to, glued to, or otherwise attached to each projectile. The cable elements 40 may be tied to the capture cable 30 at appropriate locations or be passed through a looped connecting element 42 associated with at least one of the cable elements 40 and the capture cable 30.

Figure 1C:
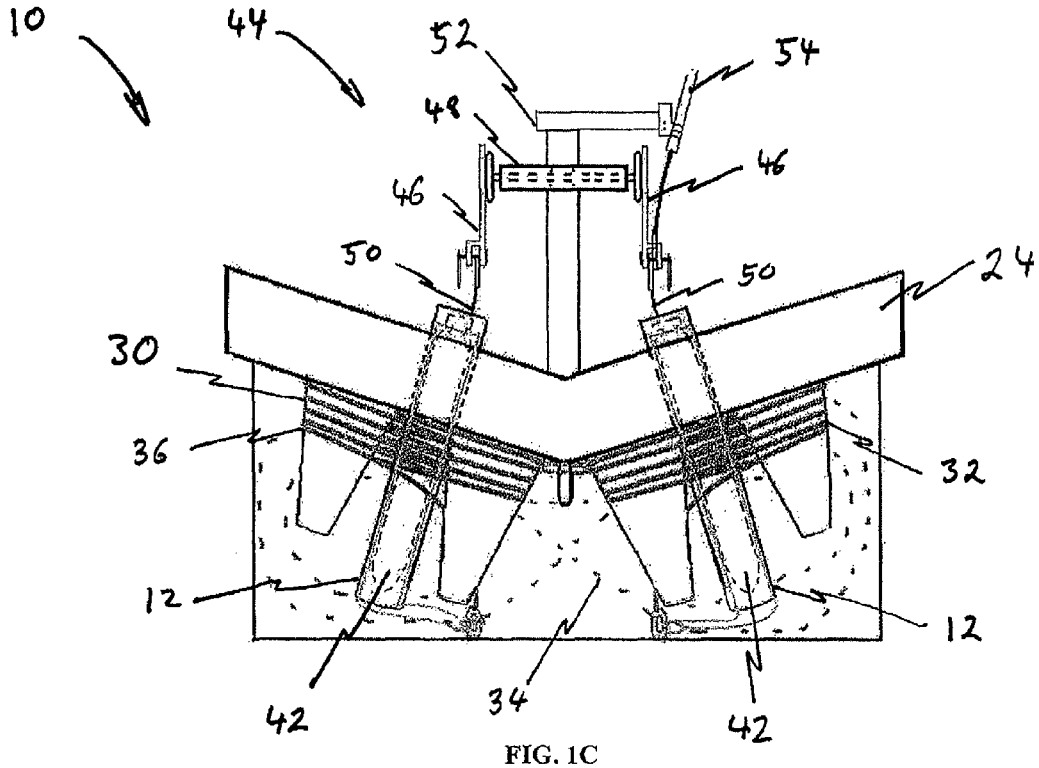
FIG. 1C is a schematic plan view of the vehicle capture system of FIG. 1A.

A plan view of the vehicle capture system 10, showing the projectiles held within the projectile tubes 12 prior to deployment, is shown in FIG. 1C. In this embodiment the projectiles are compressed air rockets 42, although in an alternative embodiment any of the projectiles discussed herein may be used. The compressed air rockets 42 may be, for example, 3000 psi aluminum rockets, although larger or smaller rockets, and rockets of different materials, are also contemplated. In general, the compressed air rockets 42 may have a pressure of between 500 and 10,000 psi, and be constructed from any metal, plastic, or composite material, as appropriate.

As shown, a single firing mechanism 44 is coupled to both compressed air rockets 42, allowing both rockets to be fired simultaneously. The firing mechanism 44 includes two pivot arms 46 coupled to a pivot 48. A triggering element 50 couples each pivot arm 46 to a triggering element, such as a firing pin or other appropriate triggering element, on the compressed air rockets 42. The firing mechanism may be supported on a frame 52 which is coupled to the frame 24 of the vehicle capture system 10. A control mechanism 54 is coupled to one of the pivot arms 46, with the other pivot arm 46 coupled through the pivot 48 to the first pivot arm 46, such that both pivot arms 46 move in unison in response to the control mechanism 54.

The control mechanism 54 can include a wire that is passed into the passenger compartment of a vehicle to which the vehicle capture system 10 is mounted. As a result, a vehicle operator can engage a user interface element, such as a switch, lever, pull handle, or other appropriate user interface element, to remotely trigger the firing mechanism 44 from inside the vehicle.

In operation, an operator within the vehicle will trigger the deployment of the capture cable 30 by activating the user interface element located within the passenger compartment of the vehicle. This will in turn pull on the wire in the control mechanism 54, which will in turn pull on one of the pivot arms 46. This pulling motion will result in both pivot arms 46 being simultaneously pivoted about the pivot 48, thus pulling on the triggering elements 50. Pulling on these triggering elements 50 engages the firing elements on each compressed air rockets 42, thus triggering and launching of the two compressed air rockets 42.

In an alternative embodiment, separate firing mechanisms may be used for each projectile. These firing mechanisms may include any appropriate mechanical, electrical, chemical, pneumatic, and/or hydraulic means of launching the projectiles. The control for the firing mechanism may include a direct mechanical and/or electrical connection, or include a remote element that may activate the firing mechanism upon sending an appropriate wireless signal to a controller on the firing mechanism. In an alternative embodiment, any appropriate control mechanism for firing the projectiles may be utilized.

In one embodiment, the projectiles can be rockets, such as compressed air propelled rockets. In alternative embodiments of the invention any other appropriate powered or unpowered projectiles may be used. These projectiles may include, but are not limited to, self-propelled rockets, unpowered missiles, or simple weighted elements. The projectiles may be propelled from the projectile tubes 12 or otherwise launched through any appropriate means, such as, but not limited to, compressed air, a spring force, a chemical reaction, an explosive reaction, or any other appropriate mechanical, chemical, magnetic, fluidic, and/or electrical propulsion means.

Figure 1D:
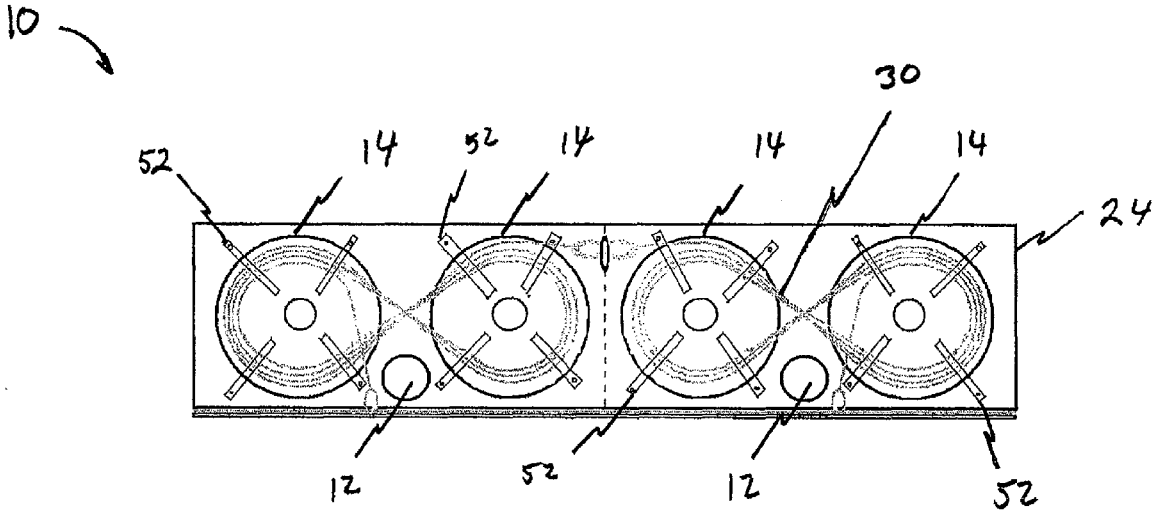
FIG. 1D is a schematic front view of a portion of the vehicle capture system of FIG. 1A.

A front view of a portion of the vehicle capture system 10 can be seen in FIG. 1D. In this embodiment, the capture cable 30 is wound around the two sets of two cable stowage elements 14 in a figure eight pattern. A plurality of strapping elements 52 are placed on the cable stowage elements 14 to releasably hold the capture cable loop 30 in place on the cable stowage elements 14 prior to deployment. These strapping elements 52 may be fastened at one end by a hook and eye type fastening, such as a Velcro® type fastening, which may be pulled open by the force of the projectiles upon deployment. As such, strapping elements 52 can assist in holding the capture cable 30 in place prior to deployment, but do not hinder the deployment of the capture cable 30 once the projectiles are launched. In an alternative embodiment, adhesive, latched, snap connection, or other appropriate fasteners may be employed on the strapping elements 52. The strapping elements 52 may be constructed from fabric, plastic, metal, or any other appropriate material that may be released or broken during deployment.

Figure 1E:
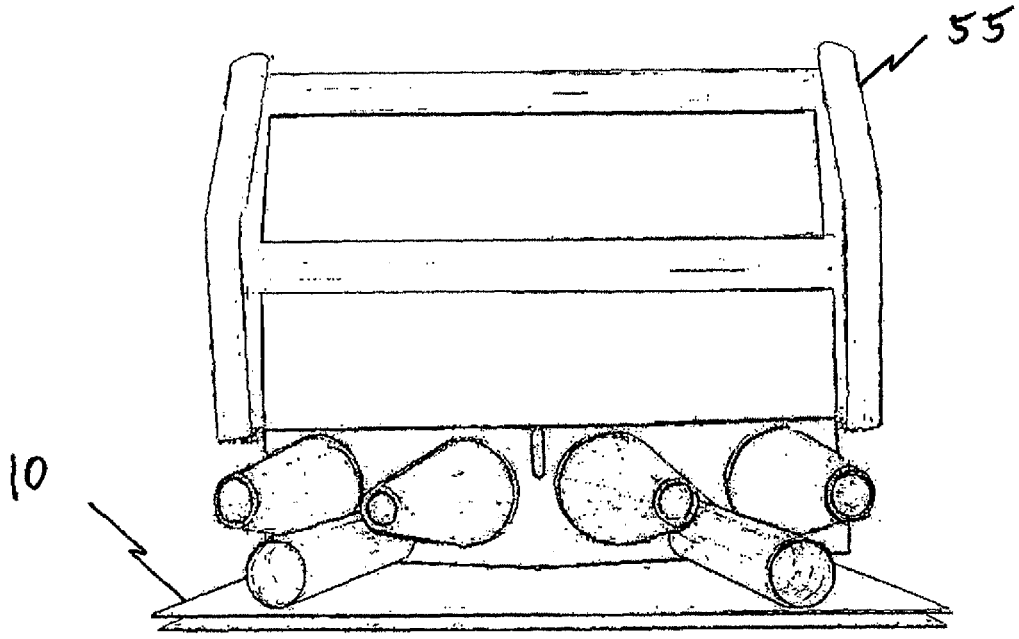
FIG. 1E is a schematic front view of the vehicle capture system of FIG. 1A mounted to a car push bumper.
Figure 1F:
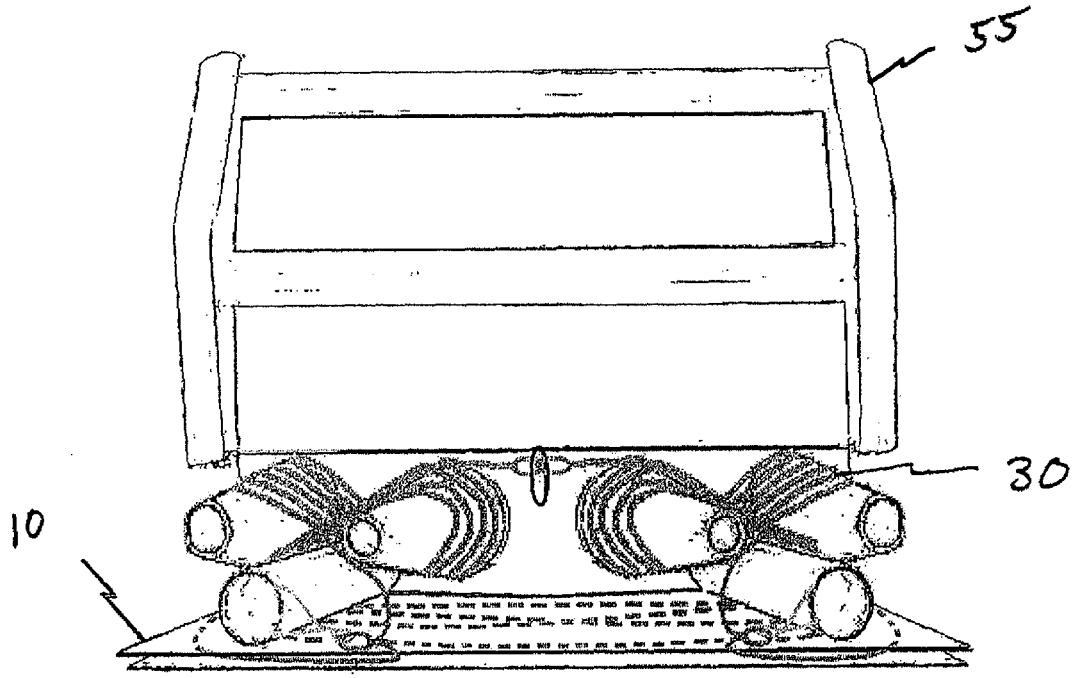
FIG. 1F is a schematic front view of the vehicle capture system of FIG. 1A, including an attached loop, mounted to a car push bumper.

FIGS. 1E and 1F show the vehicle capture system 10 mounted to a car push bumper 55, with and without the capture cable 30 shown. A car push bumper may be placed on the front of a vehicle, such as a police patrol vehicle, to provide a protective bumper for the front of the vehicle. This type of car push bumper 55 may be useful on police vehicles, where on occasion the vehicle may be used to provide a pushing force, for example to push a stalled or damaged vehicle from a roadway to clear the roadway. The vehicle capture system 10 may be adapted to couple quickly and easily to such a car push bumper 55, allowing the vehicle capture system 10 to be added to existing police patrol cars. In one embodiment, this releasable coupling may be used such that the vehicle capture system 10 may be quickly removed from a vehicle for servicing, reloading, or transfer to another vehicle.

Figure 1G:
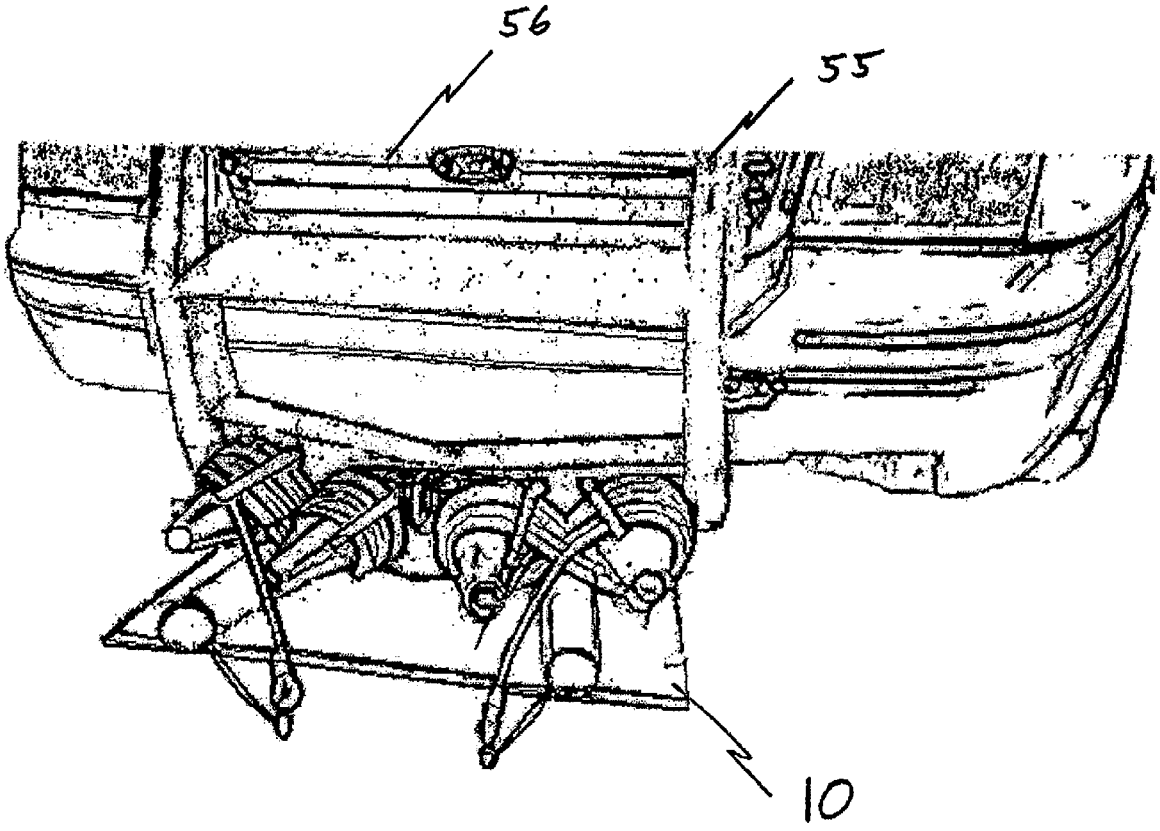
FIG. 1G is a schematic perspective view of the vehicle capture system of FIG. 1A mounted on a vehicle.

In this embodiment, the vehicle capture system 10 is positioned below the car push bumper 55. In an alternative embodiment the vehicle capture system 10 may be configured to couple to any portion of an existing car push bumper 55. In a further alternative embodiment, the vehicle capture system 10 may be permanently coupled to the car push bumper 55, or built into the car push bumper 55 during assembly of the car push bumper 55. This combined car push bumper 55/vehicle capture system 10 can then be attached to a police patrol car, or other appropriate vehicle, as required. An example of a vehicle capture system 10 mounted on a car push bumper 55 on a police patrol vehicle 56 is shown in FIG. 1G.

In another alternative embodiment, the vehicle capture system 10 may be coupled to the vehicle directly, or build into a vehicle itself. The vehicle capture system 10 can be placed at any appropriate location within the front portion of a vehicle, such as, but not limited to below, above, to one or both sides, in front of, or directly within the front hood and/or grill region of the vehicle.

In one embodiment, the vehicle capture system 10 may be hidden from clear view below the front portion of a vehicle. In another embodiment, the vehicle capture system 10 may be clearly visible. In an alternative embodiment, the vehicle capture system 10 may be placed within a covered frame, with the cover being opened prior to deployment of the capture cable 30. In this embodiment, the vehicle capture system 10 would not be visible to the pursued target vehicle until the capture cable is deployed, thus preventing the pursued target vehicle from being alerted to the possibility of being captured, and thus taking evasive maneuvers.

The vehicle capture system 10 can be of any appropriate size or shape. For example, in one embodiment, the projectile tubes may be placed close together or spaced apart to any distance up to, or even greater than, the width of the vehicle to which it is mounted. In one embodiment, the capture cable loop may be mounted at its ends within and/or to the projectile tubes, rather than to a single anchoring element on the frame of the vehicle capture system 10. In one embodiment, the vehicle capture system 10 need not have a separate frame, but rather each element of the vehicle capture system 10 can be mounted directly onto the carrier vehicle, with the ends of the capture cable loop affixed directly to the frame of the vehicle.

Figure 2:
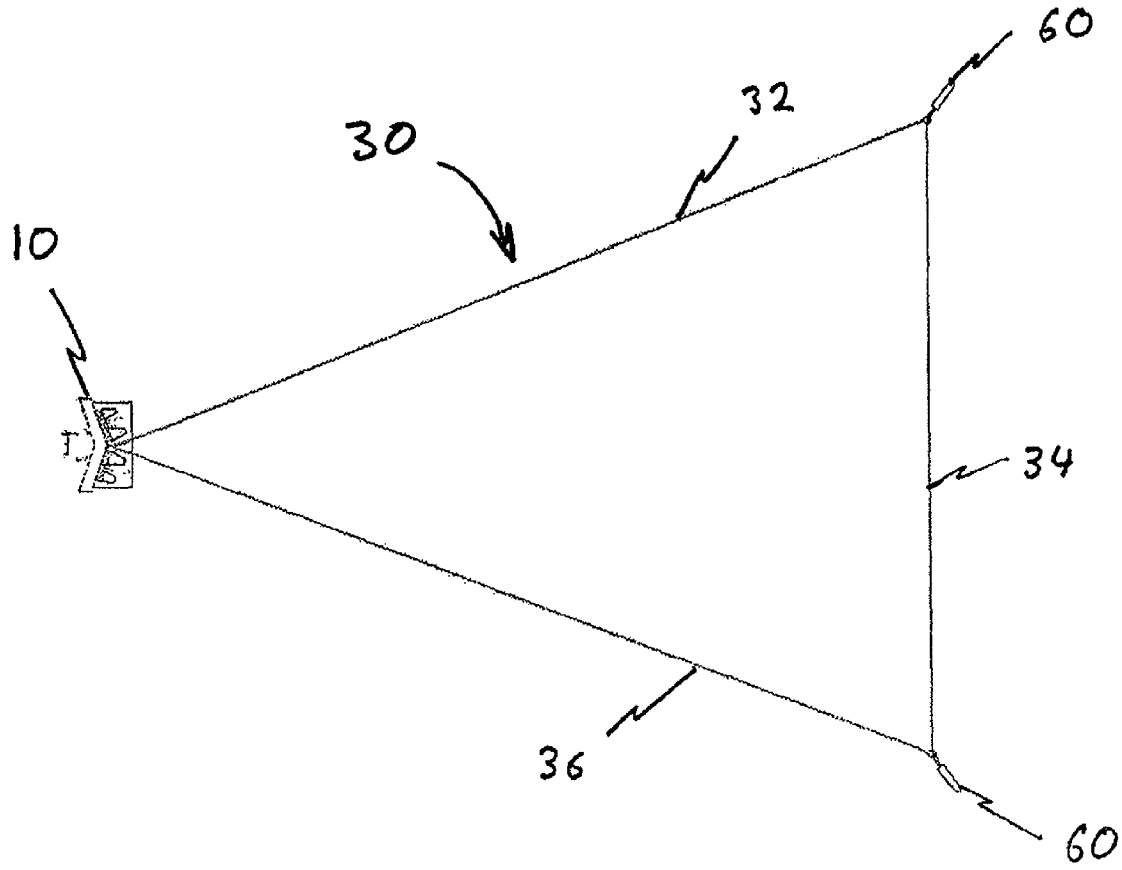
FIG. 2 is a schematic plan view of a vehicle capture system after deployment, in accordance with one embodiment of the invention.

Upon activation of the vehicle capture system 10, the projectiles are launched out from the projectile tubes in substantially the direction of the exits of the projectile tubes. An example of a deployed capture cable loop after deployment is shown in FIG. 2. In this embodiment, the projectile tubes for the vehicle capture system 10 are directed at an outward angle to the central axis of the vehicle to which it is attached. As a result, upon triggering, the projectiles 60 move away from each other and pull each portion of the capture cable 30, i.e. the first cable section 32, the second cable section 34, and the third cable section 36, tight. In one embodiment, the projectiles 60 are launched at an angle such that the second cable section 34 is tightened before the first cable section 32 and third cable section 36 are drawn tight. Thus, the second cable section 34 can remain substantially tight for a period of time as the first cable section 32 and third cable section 36 continue to extend from the vehicle capture system 10. As a result, the second cable section 34 can impinge, with force, upon the rear tires of a pursued target vehicle over a range of distances between the target and pursuing vehicles. In one example embodiment, the first cable section 32 and third cable section 36 may each be of approximately 20 foot in length, with the second cable section 34 of approximately 15 foot in length. In general, the second cable section 34 should be longer than the width of a vehicle being captured, to allow the projectiles to pass to either side of the pursued vehicle when launched.

In an alternative embodiment, the lengths of the cable sections and the angle at which the projectiles are launched are configured such that each of the cable sections is drawn taught at the same time. In a further alternative embodiment, any appropriate combination of cable section lengths and projectile directions may be utilized to provide the required performance characteristics for a specific embodiment of the invention.

In one embodiment, the projectile tubes may be directed substantially horizontally to the ground. In an alternative embodiment, the projectile tubes may be angled either upwards or downwards at a small angle, such that the projectiles can be launched in the correct direction to pull the cable section 34 towards the rear wheels of a pursued vehicle at the correct height. This angle may be dependent upon factors including, but not limited to, the vertical location of the projectile tubes on the pursuing vehicle, the distance between the pursuing and pursued target vehicle, the size of the tires of the target vehicle, and the shape of the rear portion of the pursued target vehicle.

In one embodiment of the invention, the projectile tubes may be set at a fixed angle. In another embodiment, the direction towards which the projectile tubes point may be adjustable. This adjustment may be a manual adjustment or a mechanized adjustment that can be controlled remotely by an operator prior to deployment.

Figure 3:
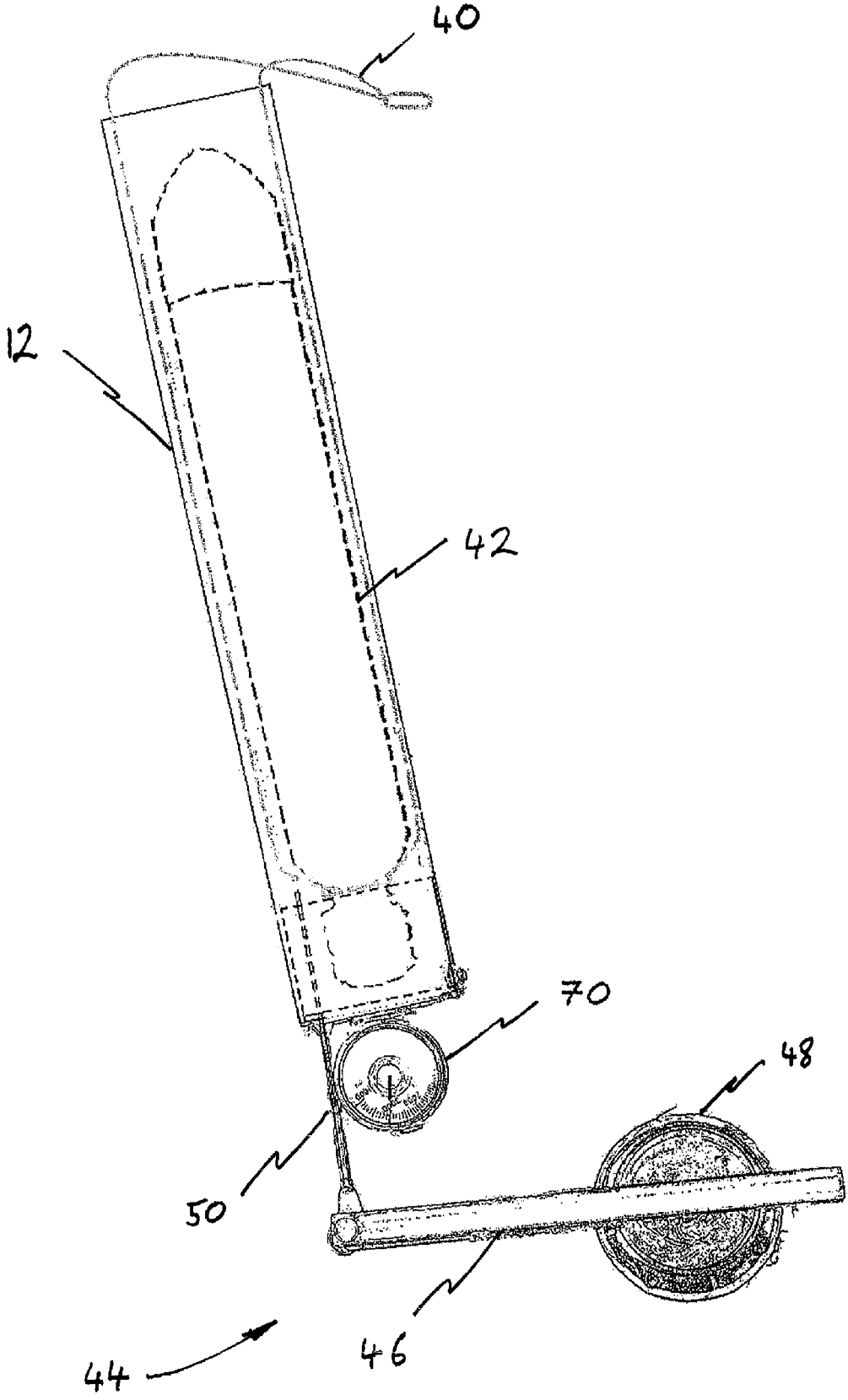
FIG. 3 is a schematic side view of a projectile launcher for a vehicle capture system, in accordance with one embodiment of the invention.
Figure 4:
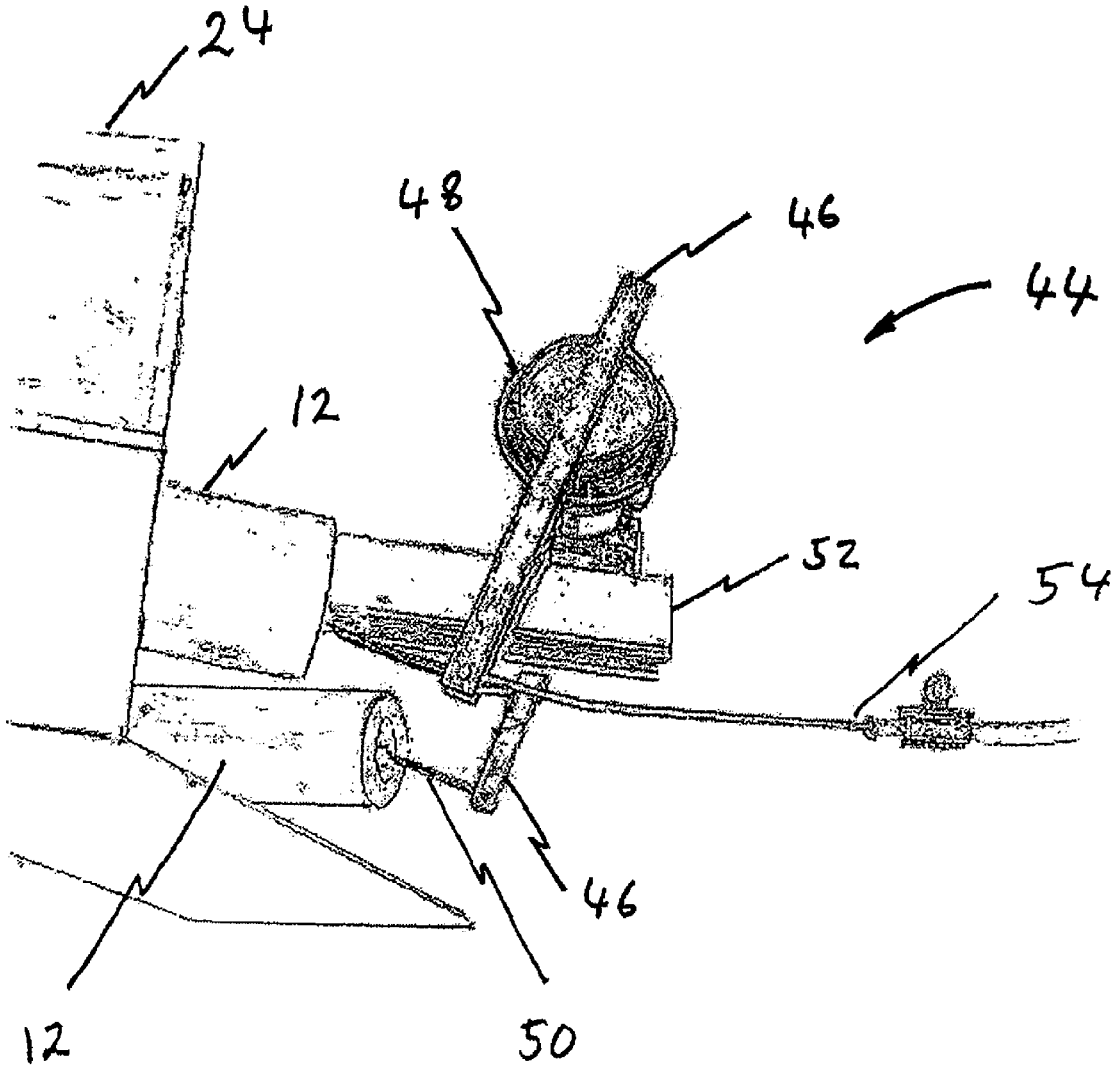
FIG. 4 is a schematic perspective view of a firing mechanism for a vehicle capture system, in accordance with one embodiment of the invention.

An example of a firing mechanism 44 and a single projectile tube 12 is shown in FIG. 3. As discussed above, a single firing mechanism 44 is coupled to both of the compressed air rockets 42, allowing both rockets to be fired simultaneously. The firing mechanism 44 includes two pivot arms 46 coupled to a pivot 48, with a triggering element 50 coupled to each pivot arm 46. The cable element 40, used to connect the compressed air rockets 42 to the capture cable 30, are tied to a rear portion of the compressed air rocket 42. A pressure gauge 70 can be used to monitor the pressure of the compressed air used to propel the compressed air rocket 42. This pressure gauge 70 can, in one embodiment, be placed on the vehicle capture system 10 or, in an alternative embodiment, be placed within the passenger compartment of the vehicle to which the vehicle capture system 10 is mounted. The air rockets 42 can be fully charged, or can be charged prior to deployment by a vehicle compressed air source controlled from the vehicle. A further example of a firing mechanism 44, showing both projectile tubes 12, is shown in FIG. 4.

Figure 5:
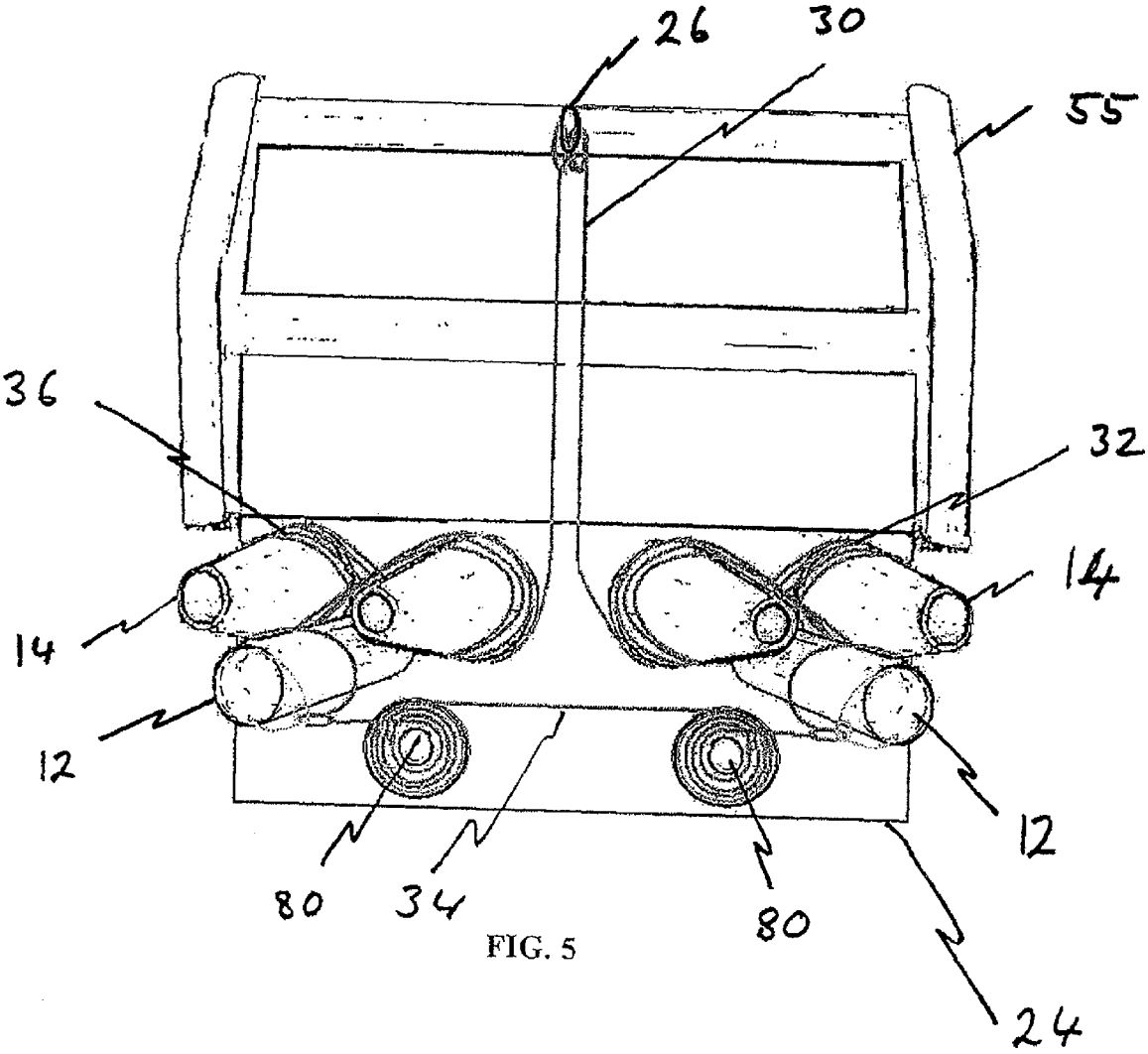
FIG. 5 is a schematic front view of another vehicle capture system, in accordance with one embodiment of the invention.

An alternative embodiment of a vehicle capture system 10 is shown in FIG. 5. In this embodiment, the second cable section 34 is stored on two cable stowage elements 80, which are coupled to the frame 24 below the projectile tubes 12. The first cable section 32 and the third cable section 36 are stored on cable stowage elements 14, as described above. The cable stowage elements 80 can be similar in shape and function to the cable stowage elements 14, and may be, for example, cone portions adapted to hold a portion of the capture cable 30 in place prior to deployment, while also allowing the capture cable to be extended easily and freely upon deployment.

In this embodiment, the anchoring element 26 is mounted directly onto the car push bumper 55. In an alternative embodiment, one or more anchoring elements 26 may be mounted at any appropriate position on the frame 24, car push bumper 55, or the vehicle itself. In one embodiment, a separate anchoring element 26 may be used for each end of the capture cable 30.

Figure 6A:
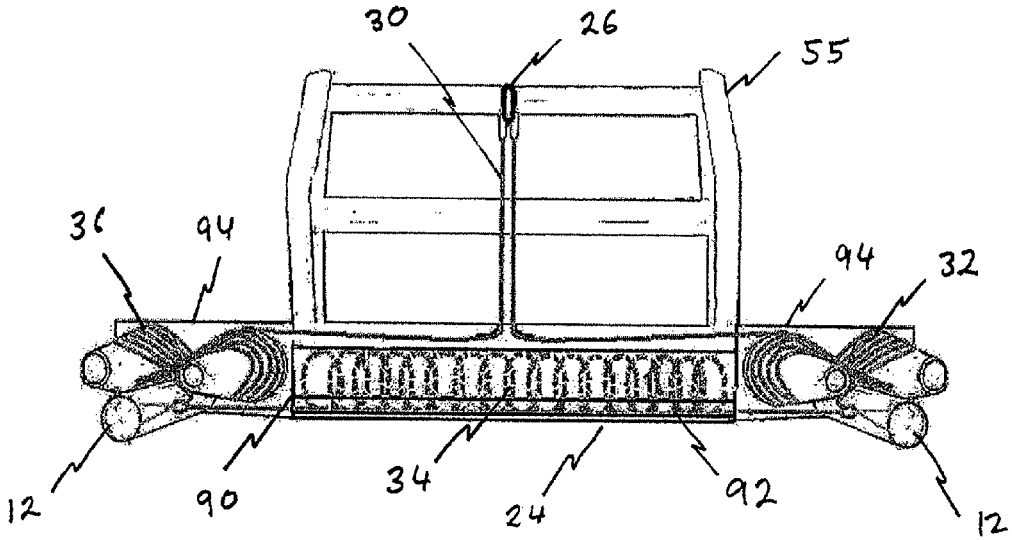
FIG. 6A is a schematic front view of another vehicle capture system, in accordance with one embodiment of the invention.
Figure 6B:
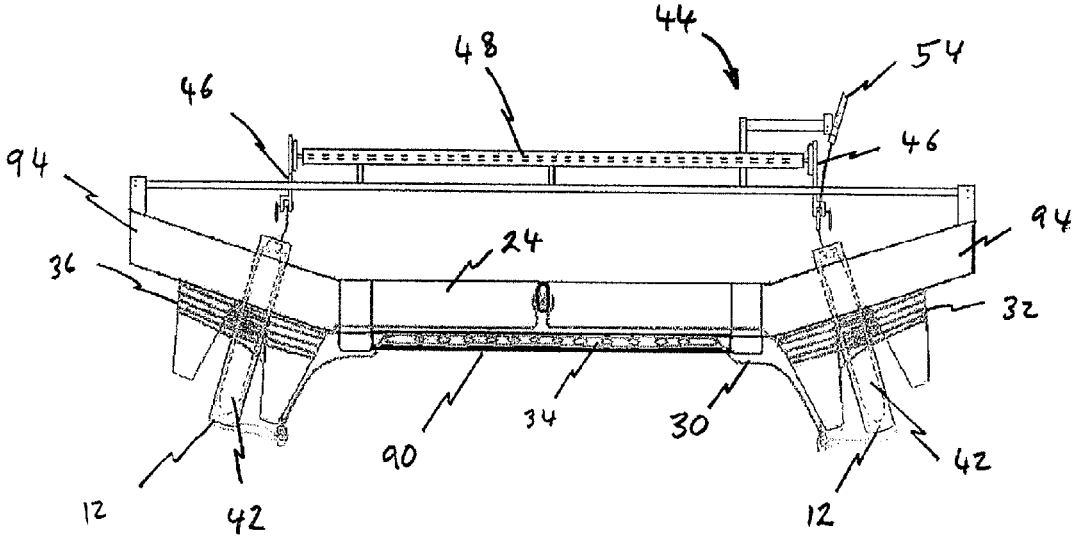
FIG. 6B is a schematic plan view of the vehicle capture system of FIG. 6A.

Another alternative embodiment of the vehicle capture system 10 is shown in FIGS. 6A and 6B. In this embodiment, the second cable section 34 is stored within a storage unit 90. The storage unit 90 may be a portion of a box with an opening 92 at its lower end. The second cable section 34 is coiled up inside the storage unit 90 prior to deployment, but can be easily pulled out from the storage unit 90 through the opening 92 when the projectiles are launched. In an alternative embodiment, the storage unit 90 may have an openable, hinged front portion that can open automatically to release the second cable section 34 upon launching the projectiles. This may be in addition to, or in place of, the opening 92.

In this embodiment, the projectile tubes 12 and cable stowage elements 14 are placed on extended frame sections 94 protruding out to either side of the car push bumper 55, with the anchoring element 26 positioned at the upper center of the car push bumper 55. As shown in FIG. 6B, the triggering mechanism 44 again includes two pivot arms 46 and a pivot 48, allowing both compressed air rockets 42, or other appropriate projectiles, to be launched simultaneously upon activation of a control mechanism 54. As discussed above, the projectile tubes 12 can be configured at any appropriate angle to the direction of travel of the vehicle, as appropriate.

Figure 7:
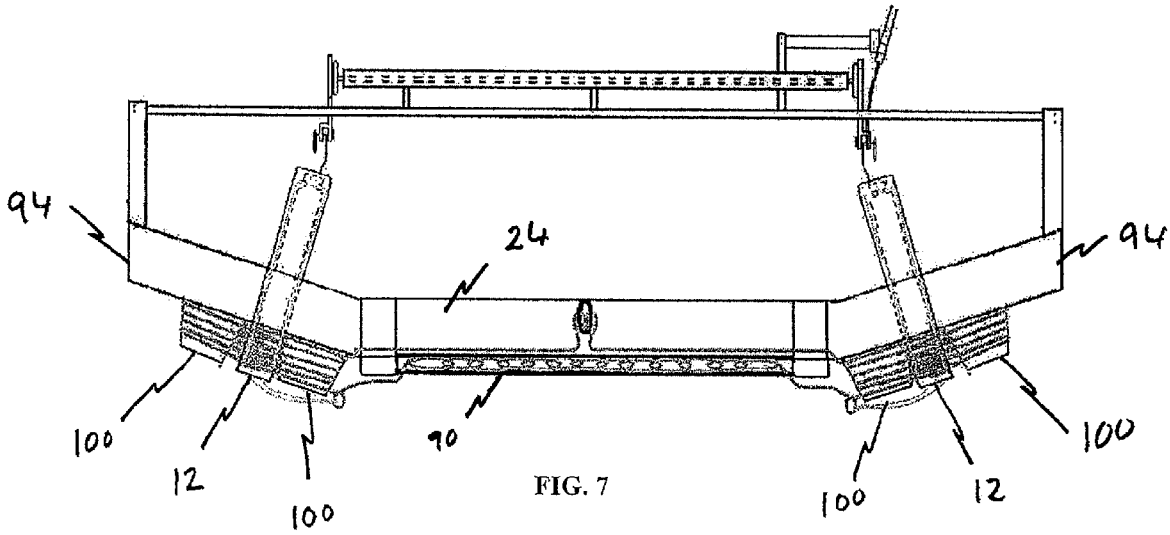
FIG. 7 is a schematic plan view of another vehicle capture system, in accordance with one embodiment of the invention.
Figure 8A:
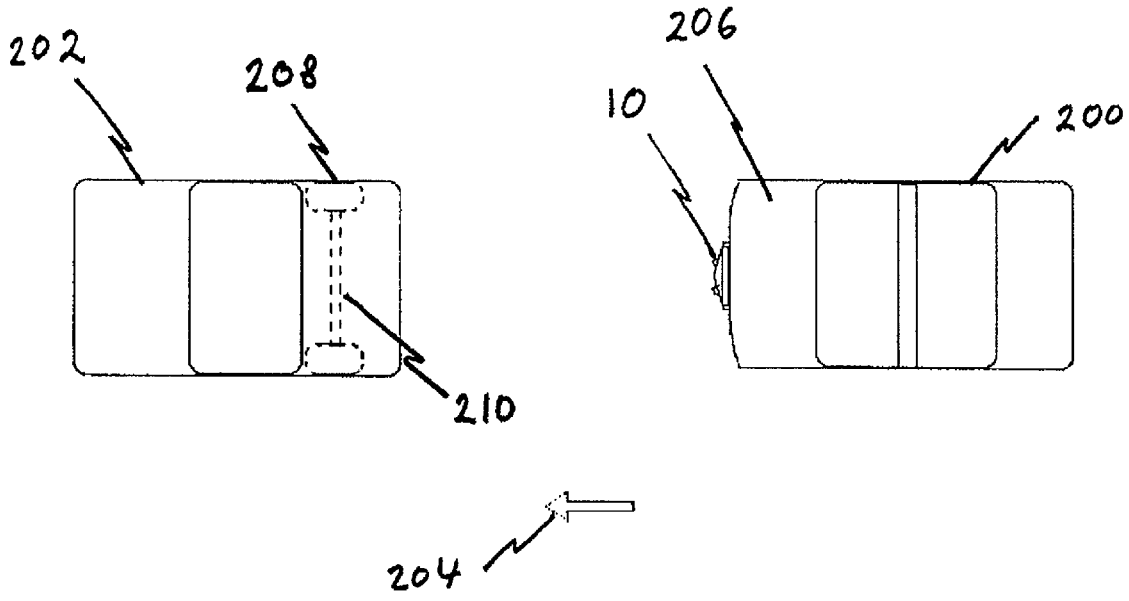
FIGS. 8A to 8E are schematic plan views showing a method of capturing a vehicle, in accordance with one embodiment of the invention.
Figure 8B:
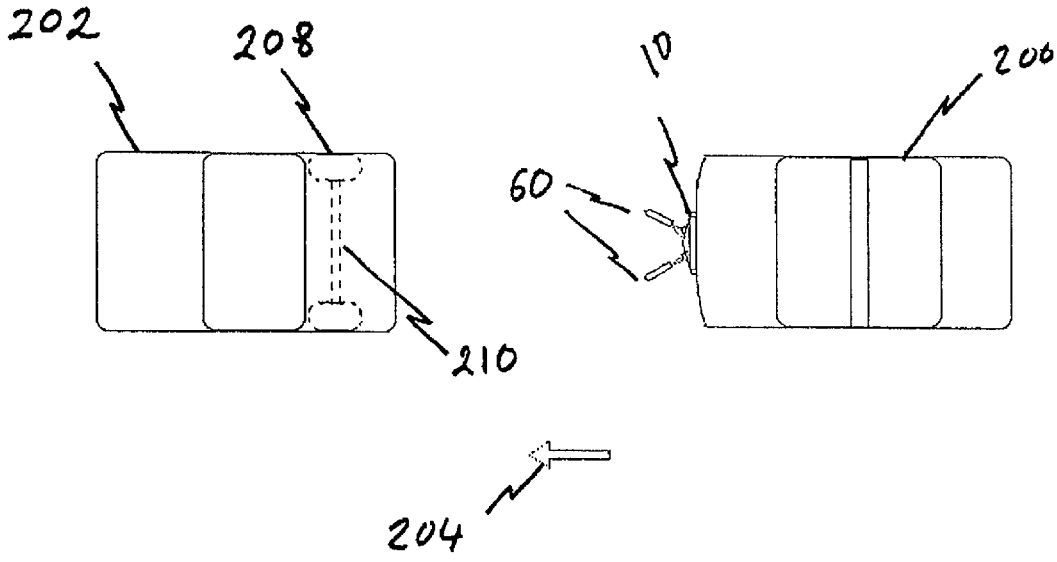
Figure 8C:
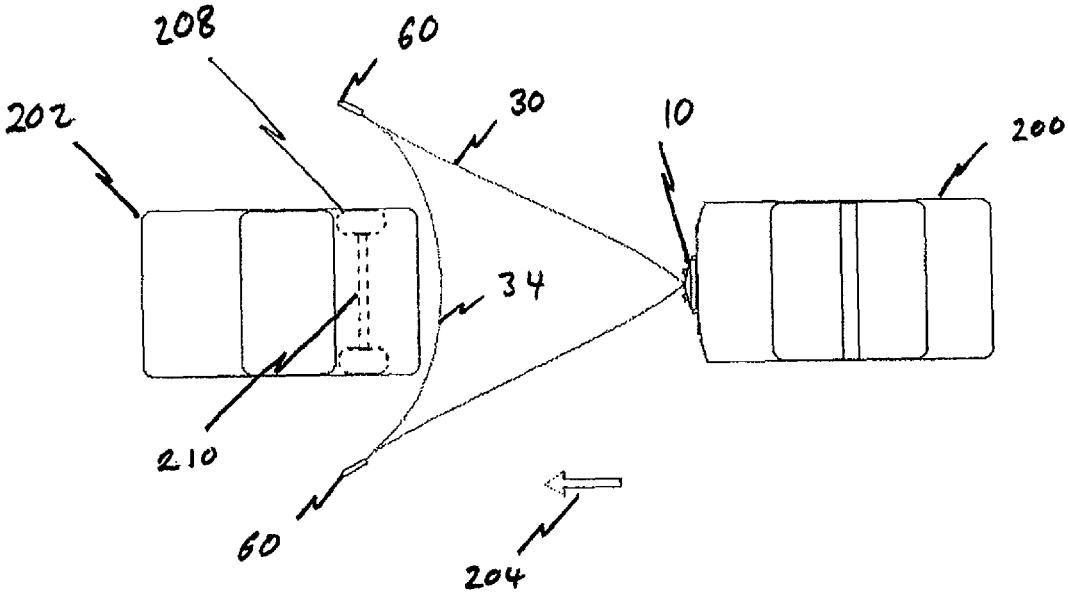
Figure 8D:
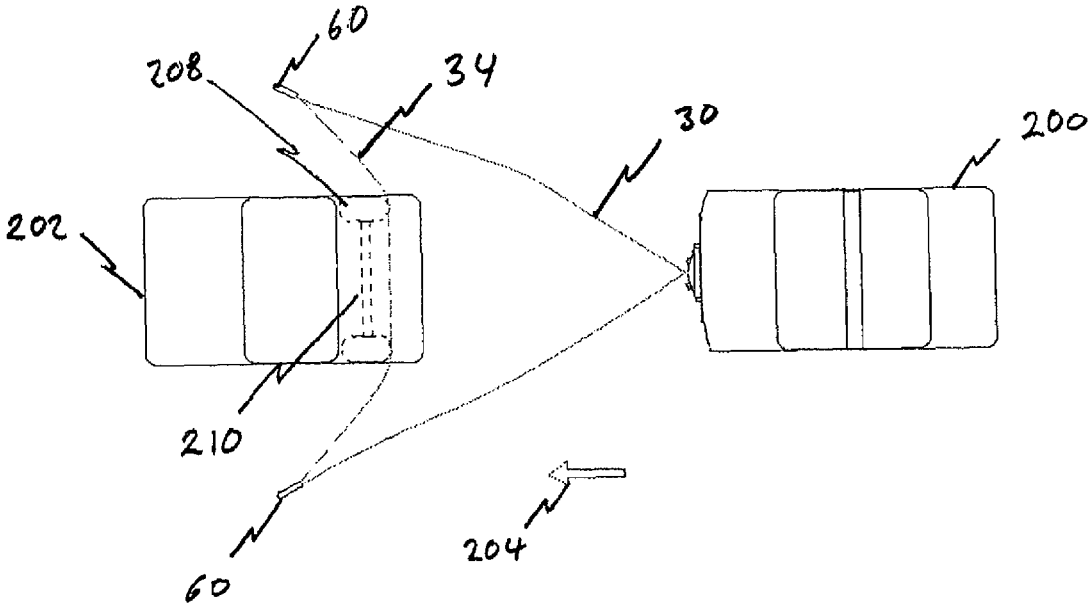
Figure 8E:
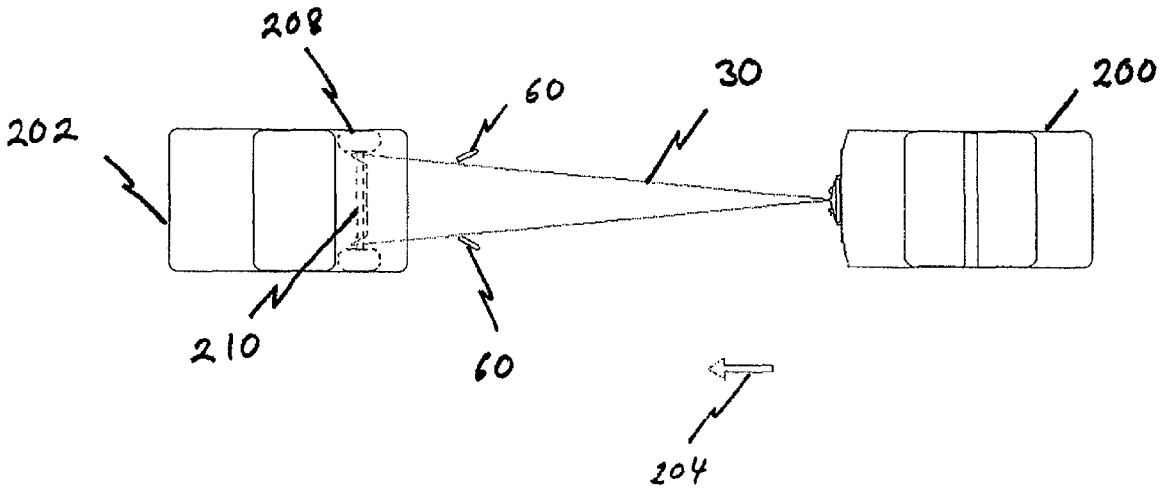

An alternative embodiment of the invention, as shown in FIGS. 6A and 6B, can be seen in FIG. 7. In this embodiment, the cable stowage elements 100 are shorter, more compact elements, with both the cable stowage elements 100 and the projectile tubes 12 configured to minimize their projection out from the frame 24 of the vehicle capture system. In general, each of the elements described herein can be configured to any appropriate size and shape and position to fit onto a specific vehicle while still providing the necessary functionality.

A method of capturing a pursued target vehicle utilizing the vehicle capture systems described herein is shown in FIGS. 8A to 8E. In one embodiment, a pursuing vehicle 200 is positioned behind a pursued target vehicle 202 with both traveling in the same direction 204. A vehicle capture system 10 is mounted on the front portion 206 of the pursuing vehicle 200.

In operation, the pursuing vehicle 200 is correctly positioned at an appropriate distance behind the pursued target vehicle 202, depending upon the length of the capture cable, the power of the projectiles, and other practical and safety concerns. Once the pursuing vehicle 200 is correctly positioned, the capture cable 30 is deployed, by being triggered by an operator within the pursuing vehicle, as described above. Once triggered, the projectiles 60 are launched out from the projectile tubes of the vehicle capture system 10 and travel substantially forwards at a small angle to the direction of travel 206. The projectiles 60 are angled such that they travel out to either side of the pursued target vehicle 202, pulling the capture cable 30 behind them.

The projectiles 60 are launched at a sufficient velocity to accelerate past the rear portion of the pursued target vehicle 202. As a result, the second cable section 34 is brought into contact with the rear portion of the rear tires 208 of the pursued target vehicle 202. As the second cable section 34 impinges upon, and is biased against, the rear portion of the rear tires 208, the frictional force between the second cable section 34 and the rear tires 208 results in the second cable section 34 being pulled up and over at least one of the rear tires 208 as they rotate. As a result, a portion of the second cable section 34 is wrapped around and hooks onto at least a portion of the underside of the pursued capture vehicle 202 and/or the rear axle 210 of the pursued target vehicle 202. As the center portion of the second cable section 34 cannot pass over the center of the rear axle 210, as it is coupled to the underside of the pursued capture vehicle 202, the pursued target vehicle 202 is effectively captured or "lassoed" by the capture cable 30. The operator of the pursuing vehicle 200 may then apply brakes to the pursuing vehicle 200 in order to bring both the pursuing vehicle 200 and the captured target vehicle 202 to a controlled stop.

It should be noted that this method will be effective even if the capture cable 30 impinges on, and is wrapped up by, only one rear tire, as the capture cable 30 will still be pulled over that tire and will thus hook around a portion of the axle of that tire.

Figure 9:
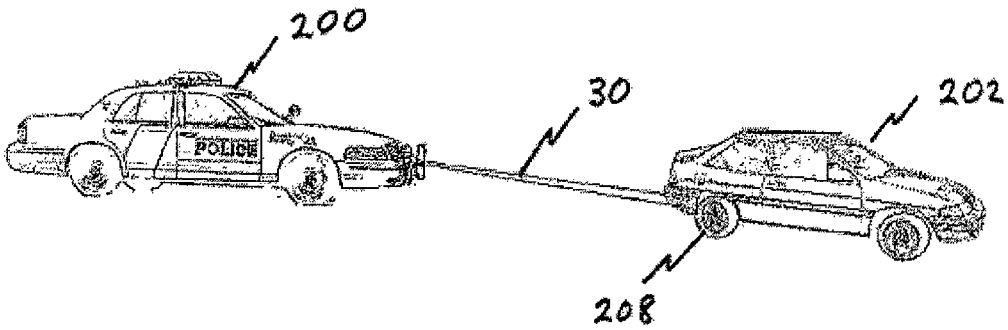
FIG. 9 is a schematic perspective view of a pursuing and captured vehicle, in accordance with one embodiment of the invention.

An example of a police patrol vehicle capturing a pursued target vehicle is shown in FIG. 9. In this embodiment, the capture cable loop 30 has been successfully looped around the rear tires 208 and axle of a captured target vehicle 202, such that the pursuing vehicle 202, namely the police patrol vehicle, is coupled to the captured target vehicle 202 by the capture cable loop 30.

Figure 10:
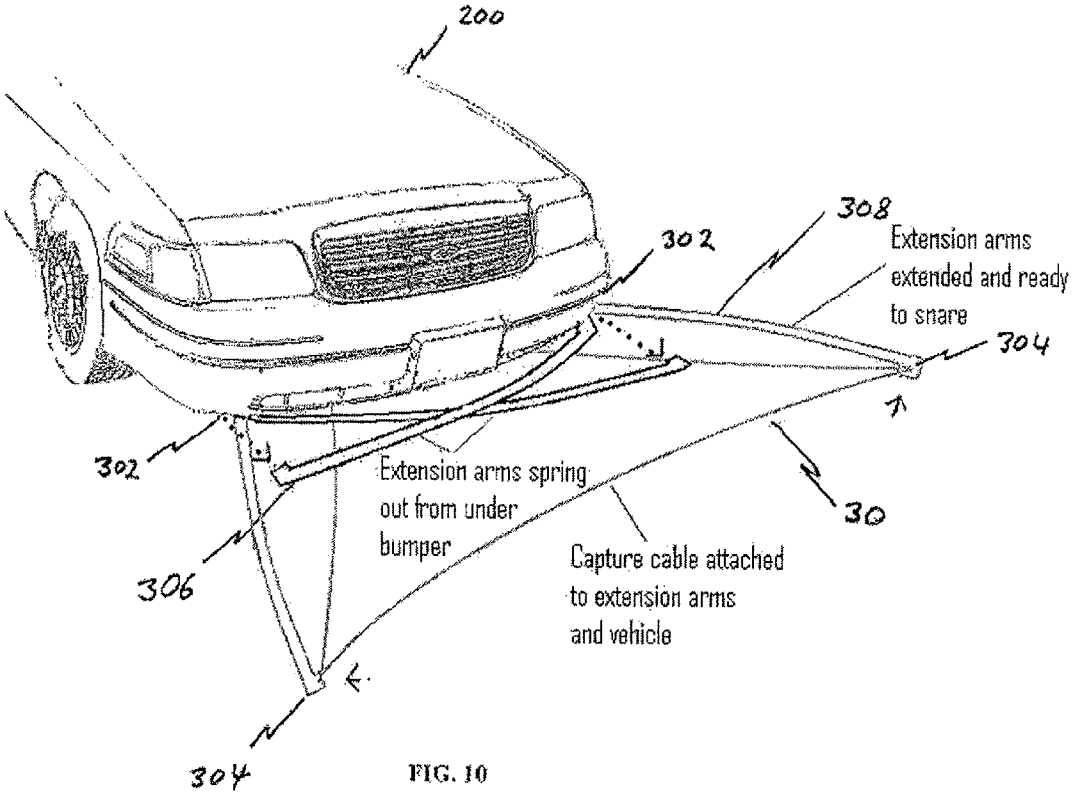
FIG. 10 is a schematic perspective view of an alternative vehicle capture system, in accordance with one embodiment of the invention.
Figure 11:
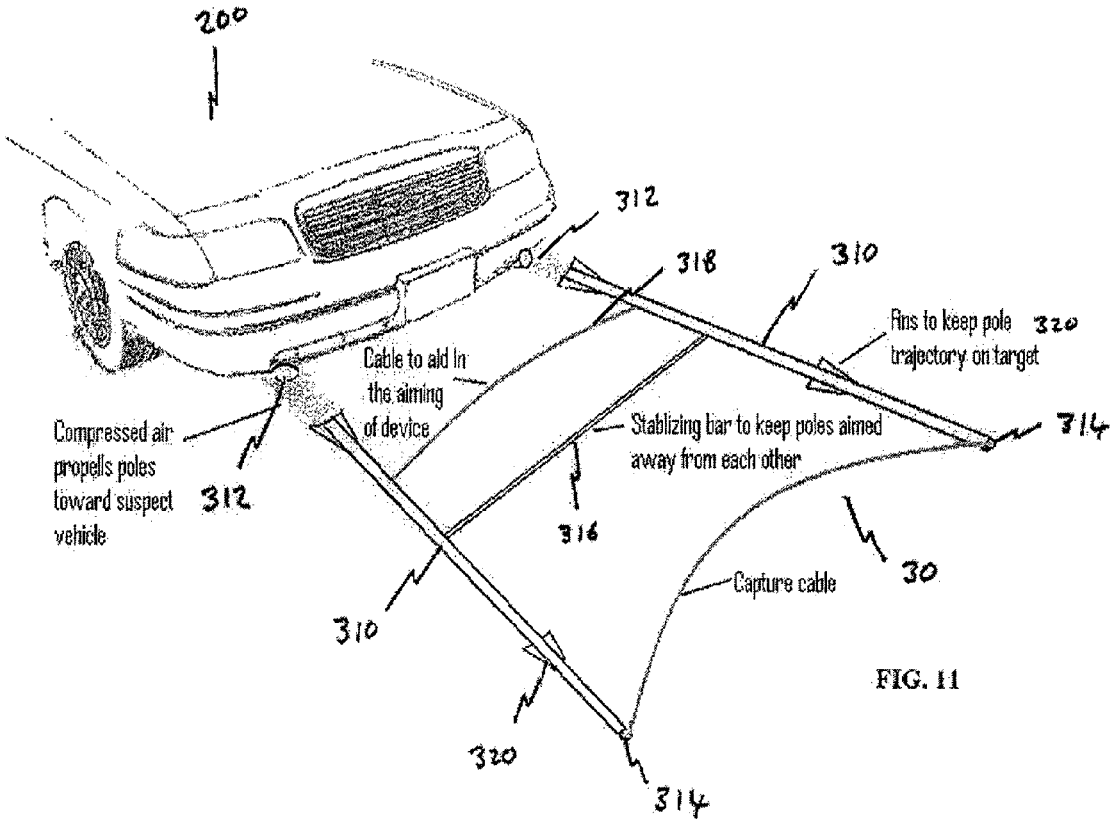
FIG. 11 is a schematic perspective view of another alternative vehicle capture system, in accordance with one embodiment of the invention.
Figure 12:
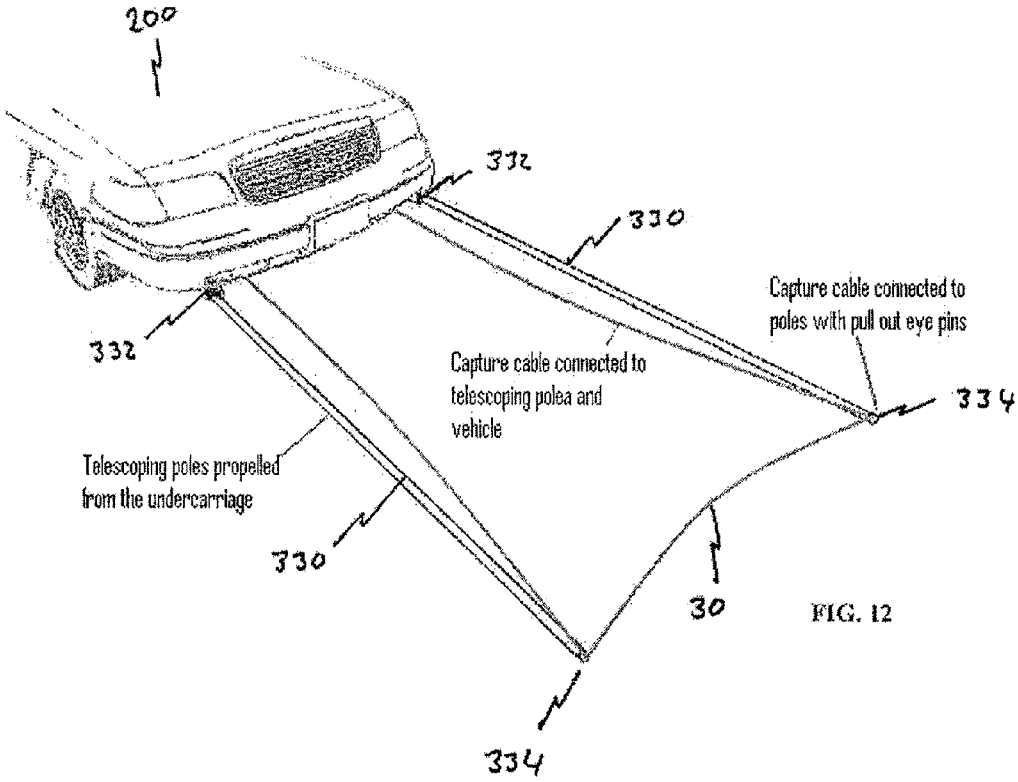
FIG. 12 is a schematic perspective view of another alternative vehicle capture system, in accordance with one embodiment of the invention.

A number of alternative embodiments of a vehicle capture system adapted to allow a capture cable to be forced against a rear portion of the rear tires of a pursued target vehicle are shown in FIGS. 10 to 12. In FIG. 10, a pair of extension arms 300 are mounted to the lower front portion of a pursuing vehicle these extension arms 300 are pivotably coupled at a proximal end 302 to a mounting on the lower front comers of the pursuing vehicle 200. A capture cable 30 is attached to the pursuing vehicle 200 at one or more anchoring points, as described above, and is looped through a coupling element at the distal end 304 of each extension arm 300. FIG. 10 shows the extension arms 300 in both a stored configuration 306 and a deployed configuration 308.

In operation, each extension arm 300 is deployed by a deployment element, such as, but not limited to, a spring element, a hydraulic element, a pneumatic element, a mechanical element, or another appropriate means of pivoting the extension arm 300. Upon activation by an operator, through, for example, a user control element within the passenger compartment of the pursuing vehicle 200, the extension arms 300 pivot out and hold a portion of the capture cable 30 in a deployed configuration in front of the pursuing vehicle 200. After the capture cable 30 has been deployed, the pursuing vehicle 200 can be accelerated forward towards the pursued target vehicle, thus forcing the capture cable 30 against the rear tires of the pursued target vehicle. The capture cable can then be forced up and over the rear tires by the frictional force between the tires and the capture cable. The capture cable will the "lasso" a portion of the rear axle, and/or a portion of the underside of the pursued target vehicle, thus capturing the target vehicle, as described above.

In one embodiment, the extension arms 300 can be configured to break away from the capture cable 30 once the target vehicle has been successfully captured. In an alternative embodiment, the extension arms 300 can remain attached to the capture cable, thus providing an additional coupling between the pursuing vehicle 200 and the capture cable 30 in addition to the coupling at the one or more anchoring elements. The extension arms 300 can be constructed from any appropriate material, such as a metal, plastic, wood, composite, or other appropriate material with sufficient structural strength to hold the capture cable 30 in place when deployed. In one embodiment, the extension arms 300 may provide some degree of flexibility or spring, while in another embodiment the extension arms 300 may be substantially stiff.

Another alternative embodiment of a vehicle capture system is shown in FIG. 11. In this embodiment, the vehicle capture system includes a pair of extension poles 310 that can be launched from projectile tubes 312 mounted to, or built into, a pursuing vehicle 200. These extension poles 310 may be launched by compressed air, or any other appropriate means, as described above.

A capture cable 30 may extend between the distal ends 314 of the two extension poles 310, and be coupled at its ends to one or more anchoring elements on the pursuing vehicle, as before. A stabilizing bar 316, and/or a guiding cable 318, can be attached to the extension poles 310 at set locations along the length of the extension poles 310 to aid in stabilizing the extension poles 310 during flight. In one embodiment, the extension poles 310 may also include a number of fins 320 adapted to aid in the flight of the extension poles 310 as they move forwards and outwards in the prescribed direction.

As with the other embodiment described herein, the extension poles 310, when deployed, will force the capture cable 30 to impinge upon the rear portion of the rear tires of a pursued target vehicle. Again, this will result in a portion of the capture cable 30 being looped over at least one of the rear tires, thus effectively lassoing the rear axle of the target vehicle.

In an alternative embodiment, the capture cable may not be coupled to the pursuing vehicle, but is merely coupled to the extension poles 310. The extension poles may include, in an example embodiment, anchoring elements that can drag on the ground and slow down the captured targeted vehicle without assistance of the pursuing vehicle. Alternatively, the engagement of the capture cable 30 itself may be enough to stop the targeted vehicle, without the need for the capture cable 30 to be coupled to the pursuing vehicle, for example by causing the emergency brake of the pursued vehicle to become engaged upon the capture cable 30 being wrapped over the rear tires.

Another alternative embodiment of a vehicle capture system is shown in FIG. 12. In this embodiment, the vehicle capture system includes a pair of telegraphing poles 330 that can be extended out from the pursuing vehicle 200 from holders 332 mounted to, or built into, the pursuing vehicle. These telegraphing poles 330 can be extended out at an angle in front of the pursuing vehicle 200, with a portion of the capture cable 30 extended between the distal ends 334 of the poles. As with the other embodiments, the capture cable 30 may be coupled to the pursuing vehicle by one or more anchoring elements attached to the pursuing vehicle 200, or to a frame mounted on the pursuing vehicle 200. The telegraphing poles 330 can be constructed from any appropriate material, such as a metal, plastic, wood, composite, or other appropriate material with sufficient structural strength to hold the capture cable 30 in place when deployed. In one embodiment, the telegraphing poles 330 may provide some degree of flexibility or spring, while in another embodiment the telegraphing poles 330 may be substantially rigid.

In one embodiment, the capture cable will not only be configured to snare one or more wheels of a pursued vehicle, but may also be able to engage the emergency brake of the pursued vehicle during the process, thereby aiding in the controlled safe stop. This may be possible as the emergency brakes are located in the rear wheels of most vehicles. In a police department fleet equipped with vehicle capture systems, up-to-date information on the location of the emergency brake on a specific pursued vehicle may be relayed to the pursuing officer, for example by a dispatch office providing the information from a database storing such information. Once it is determined that deployment of the vehicle capture system is appropriate, the dispatch officer can quickly let the pursuing officer know what to expect from the suspect vehicle in the way of how the vehicle reacts to being captured, and specifically whether or not the emergency brake could be engaged upon snaring of one or more tires.

One embodiment of the invention may include a release mechanism configured to quickly and safely disengage the capture cable from a vehicle capture system on a pursuing vehicle from a captured vehicle. This mechanism may, for example, allow the operator of the pursuing vehicle to disengage the cable from the front of the pursuing vehicle from inside the vehicle by engaging the release mechanism. The release mechanism may be operated by a lever, button, switch, or other appropriate mechanical, hydraulic, pneumatic, and/or electrical user element. In another embodiment of the invention, a release mechanism may be used to release at least a portion of the vehicle capture system, such as the capture cable, from the pursuing vehicle in the event that the deployed capture cable fails to successfully snare the tires of the pursued vehicle, such as if, for example, the capture cable is blocked or otherwise prevented from contacting and engaging the tires of the pursued vehicle. Allowing for a quick and safe release of the capture cable in such circumstances would allow the pursuing vehicle to safely continue a pursuit without having to drag the deployed capture cable behind it, should it miss its intended target.

In one embodiment of the invention, the pursued vehicle may be an average sedan with average horsepower and drive train. In this case, it is likely that a police patrol vehicle, or other pursuing vehicle utilizing the vehicle capture system, will be able to bring that pursued vehicle to a quick controlled stop by merely applying the brakes. However, in alternative embodiment, where other vehicles such as large SUV's, trucks, and sports vehicles, additional braking power may be required to enable a quick controlled stop. In this case, the pursuing vehicle may include additional apparatus to enhance the braking ability of the pursuing vehicle.

This apparatus may include, in one embodiment, one or more downriggers that may be extended down from a portion of the frame of the pursuing vehicle to impinge on the ground and provide additional stopping force. These downriggers may be extended hydraulically, pneumatically, mechanically, by electric motor, or by any other appropriate means. The downriggers may include a frame constructed from steel, aluminum, other metal, plastic, rubber or other material. The downriggers may also include tire pads constructed from rubber, plastic, or other appropriate material, that may be forced against the ground by the frame.

In an alternative embodiment, one or more skid plates may be dropped down from frame of the pursuing vehicle to enhance the braking ability of the pursuing vehicle. These skid plates may, in one embodiment, slide under one or more tires or the pursuing vehicle to increase the braking force provided by the tires. In a further alternative embodiment, any other appropriate means of increasing braking power may be incorporated into the pursuing vehicle, such as, but not limited to, one or more anchoring elements, one or more parachutes, or any other appropriate means of slowing down the pursuing and captured vehicle.

Figure 13:
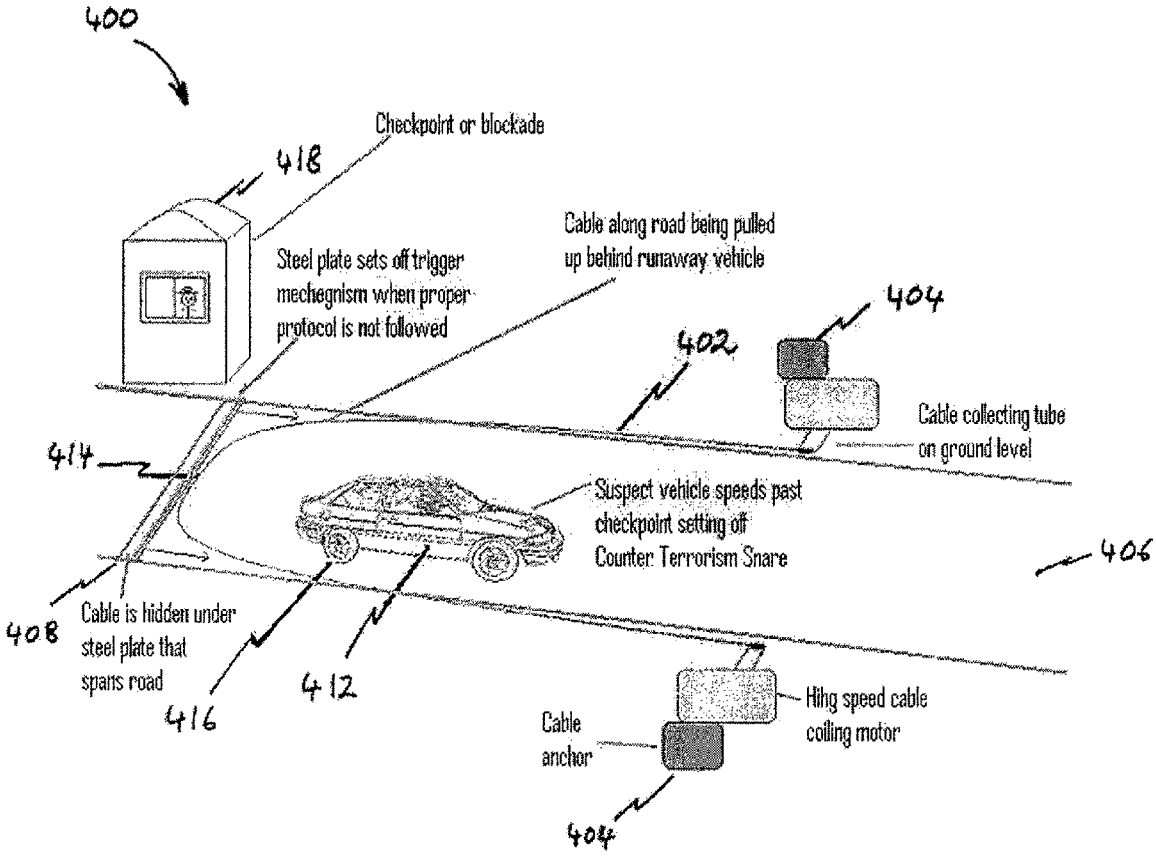
FIG. 13 is a schematic perspective view of a vehicle capture system for use with a stationary structure, in accordance with one embodiment of the invention.

An example of a stationary structure incorporating a vehicle capture system in accordance with the invention is shown in FIG. 13. In this embodiment, the vehicle capture system 400 includes a capture cable loop 402 coupled at its ends to a pair of cable anchors 404. These cable anchors may be pillars, posts, or other structures embedded into or placed on the ground on either side of a roadway 406. The capture cable loop 402 may extend behind the cable anchors 404 and span the roadway 406 at a location "up-road" of the cable anchors 404.

In one embodiment, the cable anchors may be part of a mobile security checkpoint that may be temporarily situated at a required location. These temporary cable anchors may include, but are not limited to, one or more stationary vehicles, such as a parked military vehicle, one or more portable structures, one or more weighted elements, or other appropriate temporary anchoring elements. These temporary cable anchors may or may not be anchored to, or embedded in, the ground, as appropriate.

In one embodiment, the length of capture cable 402 spanning the roadway may be hidden, prior to deployment, under a plate 408 spanning the width of the road, or a portion thereof. This plate 408 may open upon activation of the vehicle capture system 400, or include a gap allowing the capture cable 402 to pass out from under the plate 408 without disturbing it. In an alternative embodiment, the plate 408 may be hinged such that the capture cable 402 may force the plate 408 open by itself upon activation of the vehicle capture system 400. This plate 408 may also include one or more sensors designed to trigger the vehicle capture system 400 if tripped.

In one embodiment, at least one of the cable anchors 404 may include a cable winding element 410 configured to rapidly wind the capture cable 402. Upon activation, the winding element 410, or elements, rapidly wind up the extended capture cable loop 402 and thus pull the central portion 414 of the capture cable loop 402 rapidly up the roadway 406 towards the rear wheels of a target vehicle 412 that has passed over the capture cable loop 402. As with the previously described capture cable loops on the mobile mounted vehicle capture systems of FIGS. 1-12, when the capture cable loop 402 impinges on, and is biased against, the rear portion of the rear tires 416 of the target vehicle 412, it will be pulled up and over at least one of the tires 416 by the frictional force between the tires 416 and the capture cable loop 402 and will therefore engage or "lasso" the rear axle and/or a portion of the underside of the target vehicle 412. As the target vehicle 412 continues down the roadway 406, the capture cable loop 402, coupled to the cable anchors 404, will resist the travel of the captured target vehicle 412 and will therefore slow down and stop the target vehicle 412.

In one embodiment, the cable winding element(s) 410 are torqued such that they provide an increasing resistance as the capture cable is pulled by the captured vehicle 412. As a result, the capture cable 402 can slow down and stop the captured vehicle 412 in a safe, controlled manner. In an alternative embodiment, the capture cable 402 can be at least partially elastic to provide an increasing resistive force to the captured vehicle 412, thus stopping it in a controlled, safe, manner. In a further alternative embodiment the cable winding element(s) 410 can be designed to lock upon capture of the target vehicle 412, thus stopping the target vehicle 412 immediately.

In one embodiment of the invention the vehicle capture system 400 may be associated with a security checkpoint 418 or gate. This security checkpoint 418 may be operated by a security guard, who may either trigger the deployment of the vehicle capture system 400 if a suspect vehicle passes through the checkpoint, or temporarily disable an automatically deploying vehicle capture system 400 if a non-suspect vehicle passes through. In one embodiment, a specific signal may be communicated wirelessly to the security checkpoint 418 by the operator of the vehicle, or a device associated with the vehicle, to temporarily disable the vehicle capture system 400, thus allowing the vehicle to pass. In an alternative embodiment, a code may be entered into a controller at the security checkpoint 400 to prevent deployment of the vehicle capture system 400, or a security card may be swiped into a card reader at the security checkpoint to prevent deployment. Other means of temporarily opening a security gate or checkpoint known to the art may also be used.

Any appropriate sensoring means may be used to automatically trigger the vehicle capture system 400 if a vehicle passes through, such as, but not limited to, a light gate, a magnetic gate, a fluidic gate, an electrical gate, and/or a mechanical gate trigger.

In an alternative embodiment, a vehicle capture system associated with a stationary structure, such as a pair of pillars or posts at a security checkpoint, may include a pair of projectile tubes mounted to posts on either side of a roadway. In this embodiment, a capture cable is coupled at its ends to each of the two posts, with an adjoining portion lying on the roadway between the posts. As with the vehicle capture systems described above for mounting on the mobile structures, such as a police patrol vehicle, projectiles may be coupled to portions of the capture cable, so that the projectiles pull the capture cable with them when deployed. Prior to deployment, cable stowage elements can be used to compactly and safety stow portions of the capture cable, as described above.

The projectile tubes are configured to launch projectiles held within the tubes up the side of the roadway in the direction of travel of a target vehicle passing through the stationary structure. If a suspect vehicle passes through the stationary structure (for example a security checkpoint or gate) an operator can trigger the vehicle capture system. When triggered, the vehicle capture system launches the projectiles. As the projectiles are launched, they pull the capture cable with them, including the portion lying on the roadway between the two posts. As before, a portion of the capture cable is forced against the rear portion of the rear tires of the target vehicle and is wrapped up and over at least one of the tires as they revolve. The capture cable, coupled to the posts of the stationary structure, will therefore stop the vehicle once it is stretched to its full extent by the captured vehicle.

In an alternative embodiment, the vehicle capture system may be configured to automatically deploy if a vehicle passes through the stationary structure, with an action required by an operator to inhibit deployment if the vehicle is not a target. In one embodiment, a specific signal may be communicated wirelessly to the security checkpoint by the operator of the vehicle, or a device associated with the vehicle, to temporarily disable the vehicle capture system, thus allowing the vehicle to pass. In an alternative embodiment, a code may be entered into a controller at the security checkpoint to prevent deployment of the vehicle capture system, or a security card may be swiped into a card reader at the security checkpoint to prevent deployment.

It should be understood that alternative embodiments, and/or materials used in the construction of embodiments, or alternative embodiments, are applicable to all other embodiments described herein.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A vehicle capture system, comprising:

a loop adapted to be anchored to an arresting member; and means for biasing a portion of the loop against a rear portion of at least one tire of a target vehicle, the biasing means sufficient to cause the portion of the loop to be carried over the at least one tire to engage the target vehicle, wherein the biasing means comprises at least two projectiles coupled to the loop with at least a portion of the loop disposed therebetween, the projectiles adapted to be propelled substantially forward to either side of a rear portion of the target vehicle.

2. The vehicle capture system of claim 1, wherein the loop comprises at least one cable.

3. The vehicle capture system of claim 1, wherein the biasing means comprises at least one tensioning element coupled to the loop.

4. The vehicle capture system of claim 1, further comprising at least one firing mechanism adapted to propel the at least two projectiles.

5. The vehicle capture system of claim 4, further comprising at least one cable stowage element adapted to stow at least a portion of the loop prior to activating the firing mechanism.

6. The vehicle capture system of claim 1, wherein the at least two projectiles are selected from the group consisting of a rocket, a missile, and a weight.

7. The vehicle capture system of claim 4, wherein the at least one firing mechanism comprises compressed air.

8. The vehicle capture system of claim 1, further comprising a release mechanism adapted to release the loop from the arresting member when mounted thereto.

9. The vehicle capture system of claim 1, further comprising a controller adapted to activate the biasing means.

10. A method of capturing a target vehicle, the method comprising the steps of:

providing a loop anchored to an arresting member;

biasing at least a portion of the loop against a rear portion of at least one tire of a target vehicle, the biasing means sufficient to cause the portion of the loop to be carried over the at least one tire to engage the target vehicle, wherein the biasing means comprises at least two projectiles coupled to the loop with at least a portion of the loop disposed therebetween, the projectiles adapted to be propelled substantially forward to either side of a rear portion of the target vehicle; and applying tension to the loop with the arresting member to stop the target vehicle.

11. The method of claim 10, wherein the loop comprises at least one cable.

12. The method of claim 10, wherein the biasing means comprises at least one tensioning element coupled to the loop.

13. The method of claim 10, wherein the biasing means further comprises at least one firing mechanism adapted to propel the at least two projectiles.

14. The method of claim 10, wherein the at least two projectiles are selected from the group consisting of a rocket, a missile, and a weight.

15. The method of claim 10, wherein the arresting member comprises at least one stationary structure.

16. The method of claim 10, wherein the arresting member comprises at least one mobile structure.

17. The method of claim 16, further comprising positioning the mobile structure substantially behind the target vehicle prior to the biasing step.

18. The method of claim 10, further comprising the step of releasing the loop from the arresting member.

* * * * *